US009016526B2

(12) United States Patent
Evans et al.

(10) Patent No.: US 9,016,526 B2
(45) **Date of Patent: *Apr. 28, 2015**

(54) FLUID DISPENSING SYSTEM

(71) Applicant: Sakura Finetek U.S.A., Inc., Torrance, CA (US)

(72) Inventors: Robert E. Evans, Sierra Madre, CA (US); Wolfgang Mueller, Torrance, CA (US); Toshiyuki Fujimaki, Nagano (JP); Shinji Tokudaiji, Nagano (JP); Yoshitake Okabe, Higashichikuma-gun (JP); Yoshitada Mizusawa, Nagano (JP)

(73) Assignee: Sakura Finetek U.S.A., Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/297,537

(22) Filed: Jun. 5, 2014

(65) Prior Publication Data

US 2014/0284358 A1 Sep. 25, 2014

Related U.S. Application Data

(63) Continuation of application No. 13/018,609, filed on Feb. 1, 2011, now Pat. No. 8,752,732.

(51) Int. Cl.
*B65D 37/00* (2006.01)
*B05B 11/04* (2006.01)
(Continued)

(52) U.S. Cl.
CPC ..... *B05B 11/048* (2013.01); *A47K 5/1215* (2013.01); *B01L 3/523* (2013.01); *B01L 2200/0605* (2013.01); *B01L 2200/141* (2013.01); *F04B 43/08* (2013.01)

(58) Field of Classification Search
USPC ..... 222/144, 63, 113, 212, 214, 490–494, 222/566–574, 1, 310, 183, 94–105, 207, 222/213, 511; 422/562, 63; 436/46, 180; 239/119; 251/152, 156; 137/859
See application file for complete search history.

(56) References Cited

U.S. PATENT DOCUMENTS 1,621,097 A 3/1927 Zammataro
2,709,025 A 5/1955 Scott
(Continued)

FOREIGN PATENT DOCUMENTS

AU 2004266226 3/2005
CN 2390207 8/2000
(Continued)

OTHER PUBLICATIONS

Sakura Finetek USA Inc., Non-Final Office Action mailed Jun. 13, 2014 for U.S. Appl. No. 13/238,511.
(Continued)

*Primary Examiner* — Paul R Durand
*Assistant Examiner* — Randall Gruby
(74) *Attorney, Agent, or Firm* — Blakely Sokoloff Taylor & Zafman LLP

(57) ABSTRACT

An apparatus including a fluid reservoir and a compressible metering chamber including a first end coupled to the fluid reservoir and a second end. The apparatus further including a valve coupled to the second end of the metering chamber and a nozzle coupled to the valve. A system including linearly translatable cartridge mounting assembly having a plurality of fluid dispensing cartridge mounting stations and a plurality of fluid dispensing cartridges mounted to respective fluid dispensing cartridge mounting stations. The system further including a plurality of compression assemblies coupled to respective fluid dispensing cartridges and a receiving assembly positioned beneath the mounting assembly. A method includes positioning a fluid dispensing cartridge comprising a fluid reservoir and a metering chamber over a sample retaining member, applying a compressive force to the metering chamber to eject a predetermined amount of fluid and removing the compressive force to refill the metering chamber.

18 Claims, 18 Drawing Sheets

(51) Int. Cl.

| | |
|---|---|
| ***A47K 5/12*** | (2006.01) |
| ***B01L 3/00*** | (2006.01) |
| ***F04B 43/08*** | (2006.01) |

(56) References Cited

U.S. PATENT DOCUMENTS

| | | | | | |
|---|---|---|---|---|---|
| 2,772,817 | A | * | 12/1956 | Jauch | 222/207 |
| 3,008,611 | A | | 11/1961 | Mancusi, Jr. | |
| 3,066,832 | A | | 12/1962 | Rossetti | |
| 3,116,747 | A | * | 1/1964 | Cowles et al. | 137/68.23 |
| 3,232,496 | A | * | 2/1966 | Rockwell, Jr. et al. | 222/309 |
| 3,294,290 | A | | 12/1966 | Erickson et al. | |
| 3,504,699 | A | * | 4/1970 | Grise | 137/846 |
| 3,741,439 | A | | 6/1973 | Vehrs | |
| 3,752,366 | A | | 8/1973 | Lawrence, Jr. | |
| 3,794,213 | A | * | 2/1974 | Schwartzman | 222/107 |
| 3,870,201 | A | * | 3/1975 | Asplund | 222/207 |
| 3,881,641 | A | | 5/1975 | Pliml, Jr. et al. | |
| 3,904,079 | A | | 9/1975 | Kross | |
| 3,987,938 | A | | 10/1976 | Cooprider et al. | |
| 4,018,363 | A | | 4/1977 | Cassia | |
| 4,025,241 | A | | 5/1977 | Clemens | |
| 4,039,775 | A | | 8/1977 | Andra | |
| 4,067,414 | A | * | 1/1978 | Funke | 184/105.3 |
| 4,099,483 | A | | 7/1978 | Henderson | |
| 4,130,224 | A | * | 12/1978 | Norman et al. | 222/207 |
| 4,134,853 | A | | 1/1979 | Ehrlich et al. | |
| 4,135,649 | A | * | 1/1979 | Baldwin et al. | 222/511 |
| 4,143,853 | A | * | 3/1979 | Abramson | 251/149.1 |
| 4,149,573 | A | | 4/1979 | Cassia | |
| 4,149,633 | A | | 4/1979 | Nilson | |
| 4,199,558 | A | | 4/1980 | Henderson | |
| 4,256,242 | A | | 3/1981 | Christine | |
| 4,258,759 | A | | 3/1981 | Achen | |
| 4,334,640 | A | | 6/1982 | van Overbruggen et al. | |
| 4,345,627 | A | | 8/1982 | Cassia | |
| 4,349,133 | A | * | 9/1982 | Christine | 222/183 |
| 4,356,727 | A | | 11/1982 | Brown et al. | |
| 4,394,938 | A | * | 7/1983 | Frassanito | 222/207 |
| 4,440,323 | A | | 4/1984 | Benson | |
| 4,513,885 | A | | 4/1985 | Hogan | |
| 4,515,294 | A | | 5/1985 | Udall | |
| 4,561,571 | A | | 12/1985 | Chen | |
| 4,573,612 | A | | 3/1986 | Maddison et al. | |
| 4,601,411 | A | * | 7/1986 | van Overbruggen | 222/207 |
| 4,604,964 | A | | 8/1986 | Gordon et al. | |
| 4,607,764 | A | | 8/1986 | Christine | |
| 4,615,476 | A | | 10/1986 | Hobbs et al. | |
| 4,621,749 | A | | 11/1986 | Kanfer | |
| 4,646,945 | A | | 3/1987 | Steiner et al. | |
| 4,651,898 | A | | 3/1987 | Bell | |
| 4,667,854 | A | | 5/1987 | McDermott et al. | |
| 4,673,109 | A | | 6/1987 | Cassia | |
| 4,678,752 | A | | 7/1987 | Thorne et al. | |
| 4,722,372 | A | | 2/1988 | Hoffman et al. | |
| 4,731,335 | A | | 3/1988 | Brigati | |
| 4,741,461 | A | | 5/1988 | Williamson et al. | |
| 4,741,898 | A | | 5/1988 | Mallik et al. | |
| 4,764,342 | A | | 8/1988 | Kelln et al. | |
| 4,776,495 | A | | 10/1988 | Vignot | |
| 4,790,640 | A | | 12/1988 | Nason | |
| 4,798,311 | A | | 1/1989 | Workum | |
| 4,801,431 | A | | 1/1989 | Cuomo et al. | |
| 4,834,019 | A | | 5/1989 | Gordon et al. | |
| 4,838,457 | A | | 6/1989 | Swahl et al. | |
| 4,846,636 | A | | 7/1989 | Danby et al. | |
| 4,867,347 | A | | 9/1989 | Wass et al. | |
| 4,880,149 | A | | 11/1989 | Scholefield et al. | |
| 4,886,192 | A | | 12/1989 | Cassia | |
| 4,895,276 | A | | 1/1990 | Maldonado | |
| 4,917,265 | A | | 4/1990 | Chiang | |
| 4,921,136 | A | | 5/1990 | Roggenburg, Jr. | |
| 4,927,061 | A | | 5/1990 | Leigh et al. | |
| 4,932,624 | A | | 6/1990 | Holm | |
| 4,946,076 | A | | 8/1990 | Hackmann et al. | |
| 4,955,512 | A | | 9/1990 | Sharples | |
| 4,961,508 | A | | 10/1990 | Weimer et al. | |
| 4,967,940 | A | * | 11/1990 | Blette et al. | 222/214 |
| 4,969,581 | A | | 11/1990 | Seifert et al. | |
| 4,972,978 | A | | 11/1990 | DeLuca | |
| 4,974,754 | A | | 12/1990 | Wirz | |
| 4,978,036 | A | | 12/1990 | Burd | |
| 4,978,502 | A | | 12/1990 | Dole et al. | |
| 4,985,206 | A | | 1/1991 | Bowman et al. | |
| 5,002,736 | A | | 3/1991 | Babbitt et al. | |
| 5,033,656 | A | | 7/1991 | Blette et al. | |
| 5,033,943 | A | | 7/1991 | Durrum et al. | |
| 5,035,350 | A | | 7/1991 | Blette et al. | |
| 5,042,691 | A | | 8/1991 | Maldonado | |
| 5,068,091 | A | | 11/1991 | Toya | |
| 5,073,504 | A | | 12/1991 | Bogen | |
| 5,082,150 | A | | 1/1992 | Steiner et al. | |
| 5,105,992 | A | | 4/1992 | Fender et al. | |
| 5,225,325 | A | | 7/1993 | Miller et al. | |
| 5,232,664 | A | | 8/1993 | Krawzak et al. | |
| 5,242,081 | A | | 9/1993 | van der Heyden et al. | |
| 5,242,083 | A | | 9/1993 | Christine et al. | |
| 5,244,787 | A | | 9/1993 | Key et al. | |
| 5,252,293 | A | | 10/1993 | Drbal et al. | |
| 5,253,774 | A | | 10/1993 | Honig et al. | |
| 5,255,822 | A | * | 10/1993 | Mease et al. | 222/63 |
| 5,265,770 | A | | 11/1993 | Matkovich et al. | |
| 5,273,905 | A | | 12/1993 | Muller et al. | |
| 5,275,309 | A | | 1/1994 | Baron et al. | |
| 5,316,452 | A | | 5/1994 | Bogen et al. | |
| 5,322,771 | A | | 6/1994 | Rybski et al. | |
| 5,338,358 | A | | 8/1994 | Mizusawa et al. | |
| 5,355,439 | A | | 10/1994 | Bernstein et al. | |
| 5,356,039 | A | * | 10/1994 | Christine et al. | 222/107 |
| 5,390,822 | A | * | 2/1995 | Lataix | 222/30 |
| 5,418,138 | A | | 5/1995 | Miller et al. | |
| 5,421,489 | A | | 6/1995 | Holzner, Sr. et al. | |
| 5,424,036 | A | | 6/1995 | Ushikubo | |
| 5,425,918 | A | | 6/1995 | Healey et al. | |
| 5,433,351 | A | | 7/1995 | Okuyama et al. | |
| 5,439,649 | A | | 8/1995 | Tseung et al. | |
| 5,464,125 | A | * | 11/1995 | Daansen | 222/156 |
| 5,474,212 | A | | 12/1995 | Ichikawa et al. | |
| 5,492,247 | A | | 2/1996 | Shu et al. | |
| 5,501,372 | A | * | 3/1996 | Daansen | 222/207 |
| 5,525,300 | A | | 6/1996 | Danssaert et al. | |
| 5,534,114 | A | | 7/1996 | Cutright et al. | |
| 5,561,556 | A | | 10/1996 | Weissman et al. | |
| 5,578,452 | A | | 11/1996 | Shi et al. | |
| 5,579,945 | A | | 12/1996 | Ichikawa et al. | |
| 5,580,523 | A | | 12/1996 | Bard | |
| 5,595,707 | A | | 1/1997 | Copeland et al. | |
| 5,597,093 | A | | 1/1997 | Lee | |
| 5,602,674 | A | | 2/1997 | Weissman et al. | |
| 5,609,822 | A | | 3/1997 | Carey et al. | |
| 5,626,262 | A | | 5/1997 | Fitten et al. | |
| 5,639,423 | A | | 6/1997 | Northrup et al. | |
| 5,645,114 | A | | 7/1997 | Bogen et al. | |
| 5,650,327 | A | | 7/1997 | Copeland et al. | |
| 5,654,199 | A | | 8/1997 | Copeland et al. | |
| 5,654,200 | A | | 8/1997 | Copeland et al. | |
| 5,675,715 | A | | 10/1997 | Bernstein et al. | |
| 5,700,346 | A | | 12/1997 | Edwards | |
| 5,810,204 | A | | 9/1998 | Devlin et al. | |
| 5,819,842 | A | | 10/1998 | Potter et al. | |
| 5,836,482 | A | | 11/1998 | Ophardt et al. | |
| 5,839,091 | A | | 11/1998 | Rhett et al. | |
| 5,843,700 | A | | 12/1998 | Kerrod et al. | |
| 5,846,396 | A | | 12/1998 | Zanzucchi et al. | |
| 5,851,488 | A | | 12/1998 | Saul et al. | |
| 5,855,302 | A | | 1/1999 | Fisscher | |
| 5,857,595 | A | | 1/1999 | Nilson | |
| 5,885,530 | A | | 3/1999 | Babson et al. | |
| 5,909,828 | A | | 6/1999 | Salisbury | |
| 5,938,414 | A | | 8/1999 | Kayahara et al. | |
| 5,947,167 | A | | 9/1999 | Bogen et al. | |
| 5,948,359 | A | | 9/1999 | Kalra et al. | |
| 5,950,874 | A | | 9/1999 | Sindoni | |
| 5,950,878 | A | | 9/1999 | Wade et al. | |

(56) References Cited

U.S. PATENT DOCUMENTS 5,954,167 A 9/1999 Richardson et al.
5,958,341 A 9/1999 Chu
5,964,454 A 10/1999 Volpel
5,965,454 A 10/1999 Farmilo et al.
5,968,731 A 10/1999 Layne et al.
5,971,223 A 10/1999 Fisscher
6,001,309 A 12/1999 Gamble et al.
6,012,613 A 1/2000 Chen
6,017,495 A 1/2000 Ljungmann
6,020,995 A 2/2000 Dreyer et al.
6,045,759 A 4/2000 Ford et al.
6,068,162 A 5/2000 De Winter et al.
6,076,583 A 6/2000 Edwards
6,092,695 A * 7/2000 Loeffler ..... 222/207
6,093,574 A 7/2000 Druyor-Sanchez et al.
6,096,271 A 8/2000 Bogen et al.
6,131,773 A 10/2000 Wade et al.
6,142,343 A 11/2000 Wade et al.
6,152,330 A 11/2000 Polan
6,180,061 B1 1/2001 Bogen et al.
6,183,693 B1 2/2001 Bogen et al.
6,189,740 B1 * 2/2001 Wade et al. ..... 222/207
6,192,945 B1 2/2001 Ford et al.
6,206,238 B1 * 3/2001 Ophardt ..... 222/1
6,216,916 B1 4/2001 Maddox et al.
6,238,910 B1 5/2001 Custance et al.
6,244,474 B1 6/2001 Loeffler
6,259,956 B1 7/2001 Myers et al.
6,273,298 B1 8/2001 Post
6,286,725 B1 9/2001 Gerber
6,296,809 B1 10/2001 Richards et al.
6,335,166 B1 1/2002 Ammann et al.
6,343,716 B1 2/2002 Baudin et al.
6,349,264 B1 2/2002 Rhett et al.
6,352,861 B1 3/2002 Copeland et al.
6,387,326 B1 5/2002 Edwards et al.
6,415,961 B2 7/2002 Bonningue
6,416,713 B1 7/2002 Ford et al.
6,451,551 B1 9/2002 Zhan et al.
6,472,217 B1 10/2002 Richards et al.
6,489,171 B1 12/2002 Aghassi et al.
6,495,106 B1 12/2002 Kalra et al.
6,516,620 B2 2/2003 Lang
6,534,008 B1 3/2003 Angros
6,540,117 B2 4/2003 Powling
6,541,261 B1 4/2003 Bogen et al.
6,543,652 B1 4/2003 Kelder et al.
6,544,798 B1 4/2003 Christensen et al.
6,553,145 B1 4/2003 Kang et al.
6,568,561 B2 5/2003 Studer et al.
6,580,056 B1 6/2003 Tacha
6,582,962 B1 6/2003 Richards et al.
6,594,537 B1 7/2003 Bernstein et al.
6,605,213 B1 8/2003 Ammann et al.
6,607,103 B2 8/2003 Gerenraich et al.
6,632,598 B1 10/2003 Zhang et al.
6,635,225 B1 10/2003 Thiem et al.
6,656,428 B1 12/2003 Clark et al.
6,673,620 B1 1/2004 Loeffler et al.
6,703,247 B1 3/2004 Chu
6,707,873 B2 3/2004 Thompson et al.
6,720,888 B2 4/2004 Eagleson et al.
6,729,502 B2 5/2004 Lewis et al.
6,735,531 B2 5/2004 Rhett et al.
6,746,851 B1 6/2004 Tseung et al.
6,758,360 B2 7/2004 Van Giezen et al.
6,783,733 B2 8/2004 Bogen et al.
6,805,264 B2 10/2004 Houvras
6,814,262 B1 11/2004 Adams et al.
6,827,900 B2 12/2004 Thiem et al.
6,827,901 B2 12/2004 Copeland et al.
6,855,292 B2 2/2005 Angros
6,855,552 B2 2/2005 Towne et al.
6,855,559 B1 2/2005 Christensen et al.
6,899,283 B2 5/2005 Ohnishi et al.
6,943,029 B2 9/2005 Copeland et al.
6,945,128 B2 9/2005 Ford et al.
6,991,934 B2 1/2006 Walton et al.
6,998,270 B2 2/2006 Tseung et al.
7,004,356 B1 * 2/2006 Sayers ..... 222/137
7,007,824 B2 3/2006 Danby et al.
7,025,937 B2 4/2006 Plank
7,057,808 B2 6/2006 Dooling
7,070,951 B2 7/2006 Zhang et al.
7,083,106 B2 8/2006 Albany
7,118,918 B2 10/2006 Copeland et al.
7,156,814 B1 1/2007 Williamson et al.
7,165,722 B2 1/2007 Shafer et al.
7,169,601 B1 1/2007 Northrup
7,178,416 B2 2/2007 Whelan et al.
7,179,424 B2 2/2007 Williamson, IV et al.
7,187,286 B2 3/2007 Morris et al.
7,199,712 B2 4/2007 Tafas et al.
7,201,295 B1 4/2007 Sitzberger
7,209,042 B2 4/2007 Martin et al.
7,217,392 B2 5/2007 Bogen et al.
7,220,589 B2 5/2007 Richards et al.
7,226,788 B2 6/2007 De La Torre-Bueno
7,233,250 B2 6/2007 Forster
7,250,301 B2 7/2007 Angros
7,264,142 B2 9/2007 Py
7,270,785 B1 9/2007 Lemme et al.
7,275,682 B2 10/2007 Excoffier et al.
7,278,554 B2 10/2007 Armstrong
7,294,478 B1 11/2007 Hinchcliffe
7,303,725 B2 12/2007 Reinhardt et al.
7,314,238 B2 1/2008 Robert
7,323,491 B2 1/2008 Lohray et al.
7,338,803 B2 3/2008 Mizzer et al.
7,382,258 B2 6/2008 Oldham et al.
7,395,974 B2 7/2008 Albany
7,400,983 B2 7/2008 Feingold et al.
7,405,056 B2 7/2008 Lam et al.
7,425,306 B1 9/2008 Kram
7,435,381 B2 10/2008 Pugia et al.
7,435,383 B2 10/2008 Tseung et al.
7,468,161 B2 12/2008 Reinhardt et al.
7,470,401 B2 12/2008 Morales
7,470,541 B2 12/2008 Copeland et al.
7,476,362 B2 1/2009 Angros
7,501,283 B2 * 3/2009 Hersch et al. ..... 436/46
7,553,672 B2 6/2009 Bogen et al.
7,584,019 B2 9/2009 Feingold et al.
7,593,787 B2 9/2009 Feingold et al.
7,603,201 B2 10/2009 Feingold et al.
7,622,077 B2 11/2009 Angros
7,632,461 B2 12/2009 Angros
7,639,139 B2 12/2009 Tafas et al.
7,642,093 B2 1/2010 Tseung et al.
7,651,010 B2 * 1/2010 Orzech et al. ..... 222/214
7,665,630 B2 2/2010 McGill
7,677,417 B2 * 3/2010 Leiner et al. ..... 222/212
7,718,435 B1 * 5/2010 Bogen et al. ..... 436/46
7,722,811 B2 5/2010 Konrad et al.
7,735,694 B2 6/2010 Brown et al.
7,744,817 B2 6/2010 Bui
7,760,428 B2 7/2010 Sieckmann
7,806,301 B1 10/2010 Ciavarella et al.
7,838,283 B2 11/2010 Erickson et al.
7,850,912 B2 12/2010 Favuzzi et al.
7,861,890 B2 1/2011 McGill
7,880,617 B2 2/2011 Morris et al.
7,887,755 B2 2/2011 Mingerink et al.
7,897,106 B2 3/2011 Angros
7,901,941 B2 3/2011 Tseung et al.
7,922,986 B2 4/2011 Byrnard et al.
7,937,228 B2 5/2011 Feingold et al.
7,951,612 B2 5/2011 Angros
7,960,178 B2 6/2011 Key et al.
7,980,425 B2 * 7/2011 Baron et al. ..... 222/214
8,007,720 B2 8/2011 Angros
8,007,721 B2 8/2011 Angros
8,039,262 B2 10/2011 Konrad et al.
8,052,927 B2 11/2011 Angros

(56) References Cited

U.S. PATENT DOCUMENTS

| | | | | |
|---|---|---|---|---|
| 8,058,010 | B2 | 11/2011 | Erickson et al. | |
| 8,071,023 | B2 | 12/2011 | Angros | |
| 8,071,026 | B2 | 12/2011 | Rapp et al. | |
| 8,092,742 | B2 | 1/2012 | Angros | |
| 8,118,183 | B2 * | 2/2012 | Iwahashi et al. | 215/12.2 |
| 8,137,619 | B2 | 3/2012 | Ford et al. | |
| 8,142,739 | B2 | 3/2012 | Tseung et al. | |
| 8,216,846 | B2 | 7/2012 | Ljungmann et al. | |
| 8,236,255 | B2 | 8/2012 | Takayama et al. | |
| 8,257,968 | B2 | 9/2012 | Sweet et al. | |
| 8,283,176 | B2 | 10/2012 | Bland et al. | |
| 8,288,086 | B2 | 10/2012 | Metzner et al. | |
| 8,298,815 | B2 | 10/2012 | Buchanan et al. | |
| 8,315,899 | B2 | 11/2012 | Samuhel et al. | |
| 8,386,195 | B2 | 2/2013 | Feingold et al. | |
| 8,394,322 | B2 | 3/2013 | Windeyer et al. | |
| 8,394,635 | B2 | 3/2013 | Key et al. | |
| 8,396,669 | B2 | 3/2013 | Cocks et al. | |
| 8,486,714 | B2 | 7/2013 | Favuzzi et al. | |
| 8,529,836 | B2 | 9/2013 | Winther et al. | |
| 8,554,372 | B2 | 10/2013 | Windeyer et al. | |
| 8,585,985 | B2 | 11/2013 | Lihl et al. | |
| 8,609,023 | B1 | 12/2013 | Druyor-Sanchez et al. | |
| 8,663,978 | B2 | 3/2014 | Sweet et al. | |
| 8,673,642 | B2 | 3/2014 | Key et al. | |
| 8,676,509 | B2 | 3/2014 | De La Torre-Bueno | |
| 8,887,964 | B2 * | 11/2014 | Jokitalo et al. | 222/207 |
| 2001/0044603 | A1 | 11/2001 | Harrold | |
| 2002/0013194 | A1 | 1/2002 | Kitano et al. | |
| 2002/0079318 | A1 | 6/2002 | Wurzinger | |
| 2002/0110494 | A1 | 8/2002 | Lemme et al. | |
| 2002/0114733 | A1 | 8/2002 | Copeland et al. | |
| 2002/0182115 | A1 | 12/2002 | Aghassi et al. | |
| 2002/0192806 | A1 | 12/2002 | Custance et al. | |
| 2003/0100043 | A1 | 5/2003 | Kalra et al. | |
| 2003/0157545 | A1 | 8/2003 | Jevons et al. | |
| 2003/0203493 | A1 | 10/2003 | Lemme et al. | |
| 2004/0033163 | A1 | 2/2004 | Tseung et al. | |
| 2004/0033169 | A1 | 2/2004 | Shah | |
| 2004/0091395 | A1 | 5/2004 | Ward et al. | |
| 2004/0120862 | A1 | 6/2004 | Lang et al. | |
| 2004/0191128 | A1 | 9/2004 | Bogen et al. | |
| 2004/0197230 | A1 | 10/2004 | Lemme et al. | |
| 2004/0266015 | A1 | 12/2004 | Favuzzi et al. | |
| 2005/0019902 | A1 | 1/2005 | Mathies et al. | |
| 2005/0035156 | A1 | 2/2005 | Hersch et al. | |
| 2005/0064535 | A1 | 3/2005 | Favuzzi et al. | |
| 2005/0135972 | A1 | 6/2005 | Lemme et al. | |
| 2005/0150911 | A1 | 7/2005 | Bach | |
| 2005/0153453 | A1 | 7/2005 | Copeland et al. | |
| 2005/0164374 | A1 | 7/2005 | Kram | |
| 2005/0186114 | A1 | 8/2005 | Reinhardt et al. | |
| 2005/0191214 | A1 | 9/2005 | Tseung et al. | |
| 2005/0250211 | A1 | 11/2005 | Reinhardt et al. | |
| 2005/0281711 | A1 | 12/2005 | Testa et al. | |
| 2006/0019332 | A1 | 1/2006 | Zhang et al. | |
| 2006/0040341 | A1 | 2/2006 | Bland et al. | |
| 2006/0045806 | A1 | 3/2006 | Winther et al. | |
| 2006/0049208 | A1 * | 3/2006 | Daansen | 222/212 |
| 2006/0063265 | A1 | 3/2006 | Welcher et al. | |
| 2006/0088928 | A1 | 4/2006 | Sweet et al. | |
| 2006/0088940 | A1 | 4/2006 | Feingold et al. | |
| 2006/0105359 | A1 | 5/2006 | Favuzzi et al. | |
| 2006/0120921 | A1 | 6/2006 | Elliot et al. | |
| 2006/0127283 | A1 | 6/2006 | Tseung et al. | |
| 2006/0134793 | A1 | 6/2006 | Key et al. | |
| 2006/0147351 | A1 * | 7/2006 | Falb et al. | 422/100 |
| 2006/0148063 | A1 | 7/2006 | Fauzzi et al. | |
| 2006/0151051 | A1 | 7/2006 | Py et al. | |
| 2006/0169719 | A1 | 8/2006 | Bui | |
| 2006/0171857 | A1 | 8/2006 | Stead et al. | |
| 2006/0172426 | A1 | 8/2006 | Buchanan | |
| 2006/0190185 | A1 | 8/2006 | Ford et al. | |
| 2006/0191952 | A1 | 8/2006 | Kalra et al. | |
| 2006/0239858 | A1 | 10/2006 | Becker | |
| 2006/0252025 | A1 | 11/2006 | Nitta et al. | |
| 2006/0263268 | A9 | 11/2006 | Tseung et al. | |
| 2006/0265133 | A1 | 11/2006 | Cocks et al. | |
| 2006/0269985 | A1 | 11/2006 | Kitayama | |
| 2006/0275889 | A1 | 12/2006 | Angros et al. | |
| 2007/0010912 | A1 | 1/2007 | Feingold et al. | |
| 2007/0038491 | A1 | 2/2007 | Samuhel et al. | |
| 2007/0068969 | A1 * | 3/2007 | Orzech et al. | 222/214 |
| 2007/0160494 | A1 | 7/2007 | Sands | |
| 2007/0270714 | A1 | 11/2007 | Cushner et al. | |
| 2007/0272710 | A1 | 11/2007 | Bui | |
| 2008/0035677 | A1 * | 2/2008 | Daansen | 222/310 |
| 2008/0102006 | A1 | 5/2008 | Kram et al. | |
| 2008/0118378 | A1 * | 5/2008 | Baron et al. | 417/412 |
| 2008/0135583 | A1 | 6/2008 | Caswell et al. | |
| 2008/0215625 | A1 | 9/2008 | Veitch et al. | |
| 2008/0217246 | A1 | 9/2008 | Benn et al. | |
| 2008/0226508 | A1 | 9/2008 | Byrnard et al. | |
| 2008/0235055 | A1 | 9/2008 | Mattingly et al. | |
| 2008/0254503 | A1 | 10/2008 | Ljungmann et al. | |
| 2008/0286753 | A1 | 11/2008 | Erickson et al. | |
| 2008/0305515 | A1 | 12/2008 | Burgart et al. | |
| 2009/0004691 | A1 | 1/2009 | Erickson et al. | |
| 2009/0028757 | A1 | 1/2009 | Lihl et al. | |
| 2009/0108033 | A1 * | 4/2009 | Quinn et al. | 222/568 |
| 2009/0241751 | A1 | 10/2009 | Walter | |
| 2009/0308887 | A1 * | 12/2009 | Woo et al. | 222/52 |
| 2009/0325309 | A1 | 12/2009 | Favuzzi et al. | |
| 2010/0017030 | A1 | 1/2010 | Feingold et al. | |
| 2010/0028978 | A1 | 2/2010 | Angros | |
| 2010/0068757 | A1 | 3/2010 | Angros | |
| 2010/0089921 | A1 * | 4/2010 | Ellenkamp-Van Olst et al. | 220/254.3 |
| 2010/0099133 | A1 | 4/2010 | Egle et al. | |
| 2010/0178668 | A1 | 7/2010 | Elliot et al. | |
| 2011/0056991 | A1 * | 3/2011 | Brown et al. | 222/181.3 |
| 2011/0079615 | A1 | 4/2011 | Ophardt et al. | |
| 2011/0167930 | A1 | 7/2011 | Feingold et al. | |
| 2011/0176977 | A1 | 7/2011 | Tseung et al. | |
| 2011/0269238 | A1 | 11/2011 | Key et al. | |
| 2011/0297703 | A1 * | 12/2011 | Wilson et al. | 222/212 |
| 2012/0003679 | A1 | 1/2012 | Haberkorn | |
| 2012/0179293 | A1 | 7/2012 | Feingold et al. | |
| 2012/0309044 | A1 | 12/2012 | Ljungmann et al. | |
| 2013/0029409 | A1 | 1/2013 | Sweet et al. | |
| 2013/0084567 | A1 | 4/2013 | Buchanan et al. | |
| 2013/0203103 | A1 | 8/2013 | Feingold et al. | |
| 2013/0217108 | A1 | 8/2013 | Key et al. | |
| 2013/0330252 | A1 | 12/2013 | Winther et al. | |
| 2014/0038232 | A1 | 2/2014 | Key et al. | |

FOREIGN PATENT DOCUMENTS

| | | |
|---|---|---|
| DE | 385159 | 11/1923 |
| DE | 3902476 | 8/1990 |
| EP | 0185330 | 6/1986 |
| EP | 0557871 | 9/1993 |
| EP | 1028320 | 8/2000 |
| GB | 2037255 | 7/1980 |
| JP | 61200966 | 12/1986 |
| JP | 3148067 | 6/1991 |
| JP | 6510860 | 12/1994 |
| JP | 9503060 | 3/1997 |
| JP | 10501167 | 2/1998 |
| JP | 11170558 | 6/1999 |
| JP | 11258243 | 9/1999 |
| JP | 2000167318 | 6/2000 |
| JP | 2001095495 | 4/2001 |
| JP | 2001509727 | 7/2001 |
| JP | 2001512823 | 8/2001 |
| JP | 2001522033 | 11/2001 |
| JP | 2002507738 | 3/2002 |
| JP | 2002522065 | 7/2002 |
| JP | 2003057246 | 2/2003 |
| JP | 2004533605 | 11/2004 |
| WO | WO-9508774 | 3/1995 |
| WO | WO-9526796 | 10/1995 |
| WO | WO-9639260 | 12/1996 |
| WO | WO-9908090 | 2/1999 |

(56) References Cited

FOREIGN PATENT DOCUMENTS

| | | |
|---|---|---|
| WO | WO-9922867 | 5/1999 |
| WO | WO-0009650 | 2/2000 |
| WO | WO-0012994 | 3/2000 |
| WO | WO-0141918 | 6/2001 |
| WO | WO-02072264 | 9/2002 |
| WO | WO-03054553 | 7/2003 |
| WO | WO-03091710 | 11/2003 |
| WO | WO-03106033 | 12/2003 |
| WO | WO-2004059288 | 7/2004 |
| WO | WO-2004074847 | 9/2004 |
| WO | WO-2005000731 | 1/2005 |

OTHER PUBLICATIONS

Sakura Finetek, Non-Final Office Action mailed Jan. 25, 2013 for U.S. Appl. No. 13/238,575.
Sakura Finetek, Australian Examination Report dated Mar. 28, 2014, Australian Appln. No. 2012202090, 4 pages.
Sakua Finetek, Final Office Action mailed May 1, 2012 for U.S. Appl. No. 11/349,663, 13 pages.
Sakura Finetek, Extended Search Report mailed Jun. 4, 2012 for European App No. 12153210.5, 6 pages.
Sakura Finetek, Japanese Office Action dated Jul. 19, 2012 for Appln. No. 2009-512152.
Sakura Finetek, Australian Office Action mailed Sep. 21, 2012 for Application No. 2007267881.
Sakura Finetek, Final Office Action mailed Jan. 19, 2011 for U.S. Appl. No. 11/349,663, 24 pages.
Sakura Finetek, Non-final Office Action mailed Feb. 18, 2011 for U.S. Appl. No. 11/441.668, 13 pages.
Sakura Finetek, Chinese Office Action dated Mar. 31, 2011 for Appln. No. 200610007366.7, 6 pages.
Sakura Finetek, Non-final Office Action mailed Aug. 2, 2011 for U.S. Appl. No. 11/441,668, 17 pages.
Sakura Finetek, Final Office Action mailed Aug. 31, 2011 for U.S. Appl. No. 11/349,663, 20 pages.
Sakura Finetek, Non-Final Office Action mailed Jan. 31, 2012 for U.S. Appl. No. 11/349,663,12 pages.
Sakura Finetek, Australian Office Action mailed Jan. 3, 2012 for 2007267881, 5 pages.
Sakura Finetek, Chinese office action dated Jan. 18, 2012 for CN 200780019204.8.
Sakura Finetek, Japanese Office Action mailed Mar. 1, 2012 for App No. 2008-141687, 8 pages.
Sakura Finetek, Final Office Action mailed Mar. 5, 2012 for U.S. Appl. No. 11/349,663, 11 pages.
Sakura Finetek, Chinese Office Action mailed Feb. 16, 2012 for Chinese App 200610004479.1, 23 pages.
Sakura Finetek, Non-Final Office Action mailed Mar. 27, 2012 for U.S. Appl. No. 11/441,668., 15 pages.
Sakura Finetek, Japanese Office Action mailed Jan. 30, 2012 for Application No. 2009-512152, 6 pages.
Sakura Finetek U.S.A., First office action mailed Mar. 31, 2011 for EP Appln. No. 04780745.8, 3 pgs.
Sakura Finetek U.S.A., Third Office Action mailed Jun. 9, 2011 for CN Appln. No. 200610007365.2, 6 pgs.
Sakura Finetek U.S.A., Sixth Office Action mailed Mar. 31, 2011 for Chinese Appln. No. 200610007366.7, 6 pgs.
Sakura Finetek U.S.A., Chinese Office Action dated Jun. 9, 2011 for Appln. No. 2006100073652, 6 pages.
Sakura Finetek U.S.A., Japanese office action dated Jul. 6, 2011 for JP Appln. No. 2008-141687.
Sakura Finetek U.S.A., Inc., Office Action mailed Feb. 26, 2009 for U.S. Appl. No. 11/441,668.
Sakura Finetek U.S.A. Inc., CN Office Action dated May 10, 2010 for Chinese Appln. No. 200610007366.7.
Sakura Finetek U.S.A. Inc., Final office action dated May 25, 2010 for U.S. Appl. No. 11/441,668.
Sakura Finetek U.S.A., Inc., Office Action dated Jul. 21, 2010; Australian Application No. 2008229802.
Sakura Finetek U.S.A., Inc., Office Action dated Aug. 13, 2010; Australian Appln No. 2006200549.
Sakura Finetek U.S.A., Inc., Office Action mailed Oct. 11, 2010; European Appln No. 07795292.7-1234.
Sakura Finetek U.S.A., Inc., CN Office Action dated May 8, 2009 for Chinese Appln. No. 200610007366.7.
Sakura Finetek U.S.A., Inc., European Office Action dated Mar. 18, 2008 for EP Appln No. 06101497.3.
Sakura Finetek U.S.A., Inc., Non-Final Office Action mailed Nov. 29, 2012 for U.S. Appl. No. 13/238,511.
Sakura Finetek U.S.A., Inc., Non-Final Office Action dated Oct. 23, 2012 for U.S. Appl. No. 13/018,609.
Sakura Finetek U.S.A., Inc., EP Office Action dated Jun. 27, 2008, EP Appln No. 06101498.1, 9 pages.
Sakura Finetek U.S.A., Inc., EP Search Report dated Jun. 20, 2006, EP Appln No. 06101498.1, 6 pages.
Sakura Finetek U.S.A., Inc., EP Search Report dated Jun. 20, 2006, EP Appln No. 06101497.3, 6 pages.
Sakura Finetek U.S.A., Inc., EP Search Report mailed Dec. 18, 2006, EP Appln No. 06101495.7, 10 pages.
Sakura Finetek U.S.A., Inc., JP Office Action dated Dec. 26, 2008, Japanese Appln No. 2006-34547.
Sakura Finetek U.S.A., Inc., JP Office Action dated Feb. 27, 2008, Japanese Appln No. 2006-34571.
Sakura Finetek U.S.A., Inc., JP Office Action dated Feb. 27, 2008, Japanese Appln No. 2006-030350.
Sakura Finetek U.S.A., Inc., JP Office Action dated Nov. 30, 2007, Japanese Appln No. 2006523317, 9 pages.
Sakura Finetek U.S.A., Inc., Office Action mailed Jul. 23, 2007, EPO Application No. 06101495.7.
Sakura Finetek U.S.A., Inc., PCT Search Report dated Aug. 8, 2006, PCT Appln No. PCT/US04/25960, 10 pages.
Sakura Finetek U.S.A., Inc., PCT Search Report mailed Nov. 16, 2007, PCT Appln No. PCT/US2007/012400, 13 pages.
Sakura Finetek USA Inc., Office Action mailed Jun. 25, 2012; European Appln No. 07795292.7, 6 pages.
Sakura Finetek USA Inc., Final Office Action dated Oct. 9, 2013 for U.S. Appl. No. 13/018,609.
Sakura Finetek USA, Inc., Canadian Office Action dated Feb. 25, 2013 for Appln. No. 2652898.
Sakura Finetek USA, Inc., Final Office Action dated Mar. 14, 2013 for U.S. Appl. No. 13/018,609.
Sakura Finetek USA, Inc., Final Office Action dated Apr. 5, 2013 for U.S. Appl. No. 13/238,511.
Sakura Finetek USA, Inc., Non-Final Office Action dated Jul. 1, 2013 for U.S. Appl. No. 13/018,609.
Shi, Shan-Rong, et al., "Enhancement of immunochemical staining in aldehyde-fixed tissue", Reissue U.S. Appl. No. 11/249,180, filed Oct. 11, 2005.
Zhang, Guangrong, et al., "Deparaffinization compositions and methods for their use", Reissue U.S. Appl. No. 11/250,142, filed Oct. 13, 2005.
European Office Action mailed Jan. 7, 2015 for European App No. 12153210.5, 4 pages.

* cited by examiner

FLUID DISPENSING SYSTEM

CROSS-REFERENCE TO RELATED APPLICATION

This application is a continuation of co-pending U.S. patent application Ser. No. 13/018,609, filed Feb. 1, 2011 and incorporated herein by reference.

FIELD

A fluid dispensing system, specifically a fluid dispensing apparatus that may be used in a biological sample processing system.

BACKGROUND

In various settings, processing and testing of biological specimens is required for diagnostic purposes. Generally speaking, pathologists and other diagnosticians collect and study samples from patients, and utilize microscopic examination, and other devices to assess the samples at cellular levels. Numerous steps typically are involved in pathology and other diagnostic process, including the collection of biological samples such as blood and tissue, processing the samples, preparation of microscope slides, staining, examination, re-testing or re-staining, collecting additional samples, re-examination of the samples, and ultimately the offering of diagnostic findings.

While conducting biological tests, it is often necessary to dispense liquids, such as reagents, onto test slides containing the biological specimens. When analyzing tumor tissue for example, a thinly sliced section of the tissue might be placed on a slide and processed through a variety of steps, including dispensing predetermined amounts of liquid reagents onto the tissue. Automated reagent fluid dispensing systems have been developed to precisely apply a sequence of pre-selected reagents to test slides.

A representative reagent dispensing system includes a reagent dispensing tray which supports multiple reagent containers and is capable of positioning selected reagent containers over slides to receive reagent. The system further includes an actuator to facilitate ejection of a reagent out of the reagent container. During operation, the reagent dispensing tray positions a reagent container adjacent the actuator. The actuator (e.g. piston) contacts, for example, a spring loaded displacement member associated with the reagent container, effecting movement of the displacement member, which in turn causes reagent fluid to be applied over the slides.

BRIEF DESCRIPTION OF THE DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

In the following paragraphs, the invention will be described in detail by way of example with reference to the accompanying drawings. Throughout this description, the embodiments and examples shown should be considered as exemplars, rather than as limitations on the invention. Furthermore, reference to various aspects of the embodiments disclosed herein does not mean that all claimed embodiments or methods must include the referenced aspects.

Figure 1A:
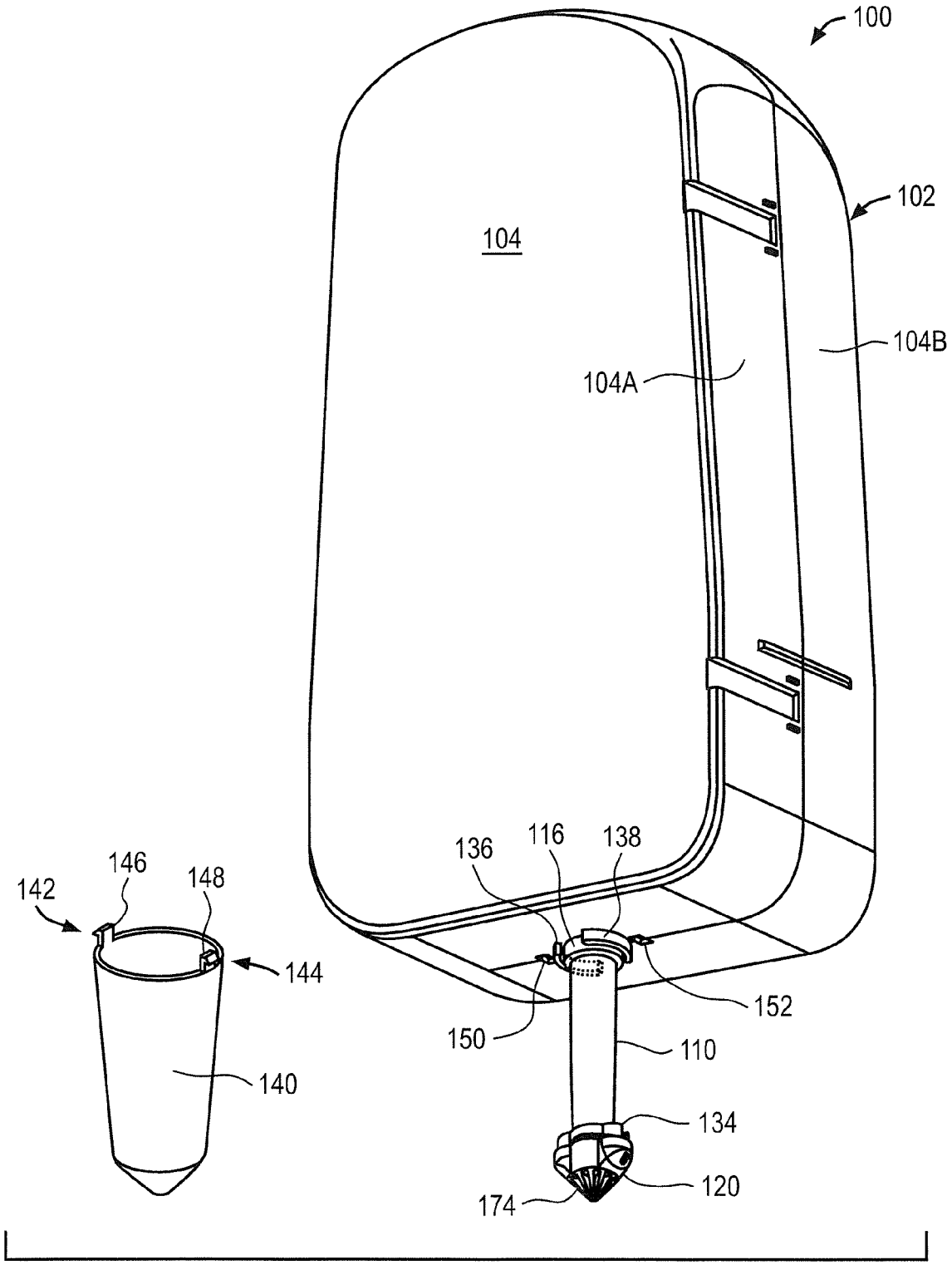
FIG. 1A illustrates a perspective view of one embodiment of a fluid dispensing system.

FIG. 1A illustrates one embodiment of a fluid dispensing system. The fluid dispensing system may be fluid dispensing cartridge 100 which generally includes fluid reservoir 102 in fluid communication with metering chamber 110. Fluid reservoir 102 generally includes a container that is configured to hold a predetermined amount of fluid, such as a reagent or rinsing fluid. In some embodiments, reservoir 102 includes housing 104.

Housing 104 may be a rigid housing that is constructed from a fluid impermeable material. It should also be appreciated that housing 104 may be constructed from any material suitable for holding liquid such as a chemically inert plastic, for example polyethylene or polypropylene. In addition to containing a fluid, housing 104 may further provide a grasping surface for handling and a marking surface so information may be recorded on the cartridge, for example, by writing on the surface or affixing a label. The label may be, for example, a bar code or a radio frequency identification (RFID) tag which identifies the contents of reservoir 102 and/or a processing protocol.

In some embodiments, housing 104 is a clam shell housing having first portion 104A and a second portion 104B. First portion 104A and second portion 104B may be separate pieces which are positioned around metering chamber 110 and attached together to form housing 104. In some embodiments, first portion 104A and second portion 104B are held together by, for example, a detent or snap fit mechanism. It is contemplated that in some embodiments, when first portion 104A and second portion 104B are secured to one another, air is allowed to pass through the seam formed by the portions. In this aspect, the seam provides a venting mechanism for air to enter into and equalize a pressure within housing 104. In such embodiments, a liquid within housing 104 may be within a fluid bladder or liner positioned within housing 104 as will be described in more detail in reference to FIG. 1B. In still further embodiments, a valve is provided in housing 104 (see FIG. 1B) to allow for venting of air.

Metering chamber 110 extends from a base of fluid reservoir 102 and housing 104 (as viewed). In one embodiment, metering chamber 110 is a cylindrical member, for example a tubular structure of a deformable material. Metering chamber 110 will be described in more detail in reference to FIG. 2.

Nozzle 120 may be positioned at an end of metering chamber 110. An outer surface of nozzle 120 may include cut outs 174 to help reduce the amount of material needed to make nozzle 120 and in turn, a weight of nozzle 120. Nozzle 120 may be secured to metering chamber 110 with nozzle locking mechanism 134. Nozzle locking mechanism 134 may be a cylindrical piece which encircles metering chamber 110 and includes arms that attach to nozzle 120 to hold nozzle 120 onto metering chamber 110. Representatively, the arms of nozzle locking mechanism 134 may include hooks which hook under protruding regions formed within nozzle 120. (see FIG. 2). Nozzle 120 may be constructed from any material suitable for holding liquid such as a chemically inert plastic, for example, polyethylene or polypropylene. The attachment of nozzle 120 to metering chamber 110 helps to control fluid ejection from metering chamber 110.

In some embodiments, collar 116 and extenders 136,138 may encircle an upper region of metering chamber 110. Collar 116 secures an end of metering chamber 110 within the opening of housing 104. Extenders 136, 138 may facilitate connection of metering chamber 110 to a compression assembly designed to drive ejection of fluid from metering chamber 110.

Cover 140 may further be provided to cover and protect metering chamber 110 during shipping of cartridge 100. Cover 140 may have any dimensions suitable for covering the portion of metering chamber 110 extending outside of housing 104. Representatively, cover 140 may be a hollow, cylindrical plastic structure which tapers in diameter. Hooks 142, 144 extending from the edges forming the open end of cover 140 may be used to attach cover 140 to housing 104. Hooks 142, 144 include barbed ends 146, 148, respectively. Housing 104 may include openings 150, 152 on opposite sides of metering chamber 110. Openings 150, 152 are dimensioned to receive hooks 142, 144. When barbed ends 146, 148 of hooks 142, 144 are inserted within openings 150, 152, respectively, barbed ends 146, 148 catch on the edges of openings 150, 152 to hold cover 140 in place. Cover 140 may be removed by squeezing cover 140 to dislodge barbed ends 146, 148 and pulling cover 140 in a direction away from housing 104. Although a hook type fastening mechanism is disclosed, it is further contemplated that any other mechanism suitable for securing cover 140 to housing 104 may be used.

Figure 1B:
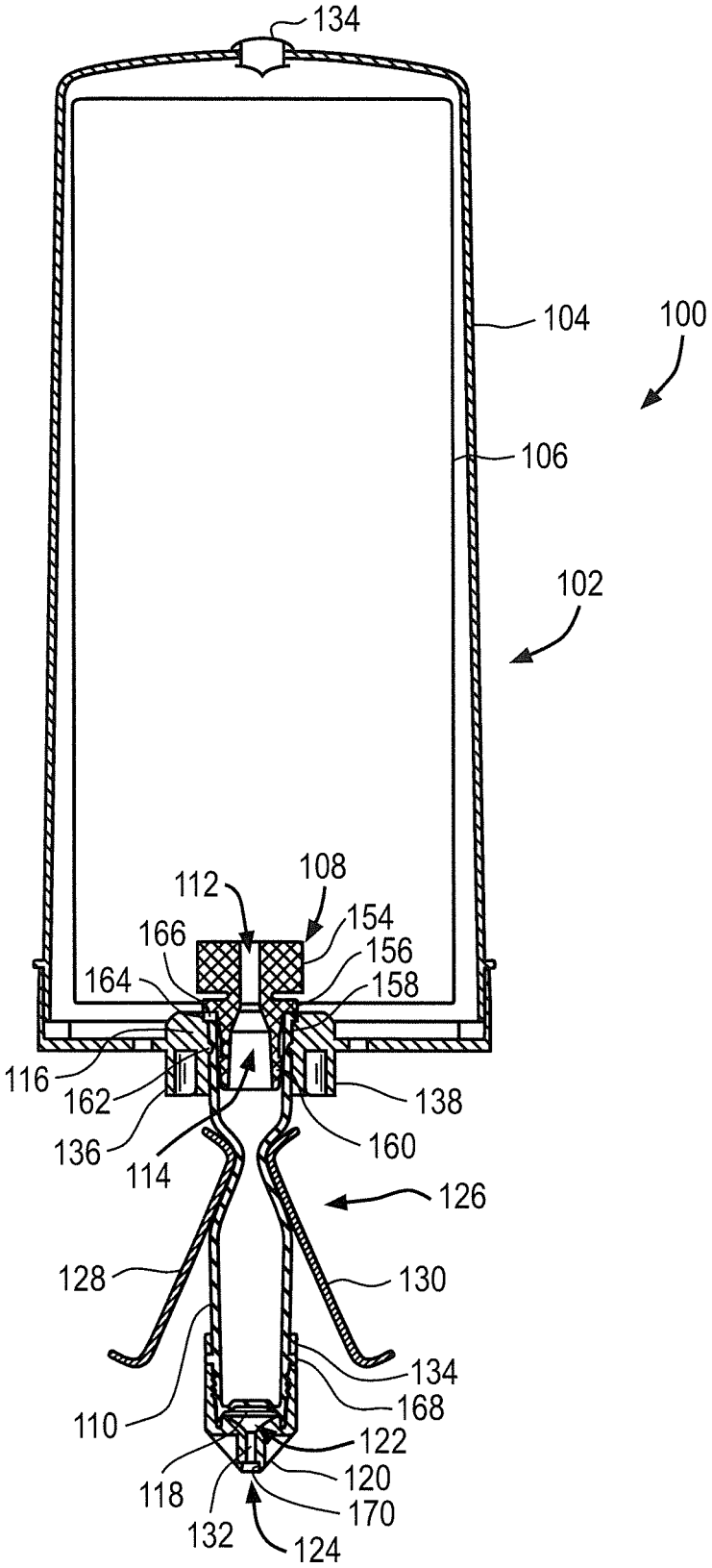
FIG. 1B illustrates a cross-sectional view of one embodiment of a fluid dispensing system.

FIG. 1B illustrates a cross sectional view of the fluid dispensing system of FIG. 1A through the middle of the fluid dispensing system. In this aspect, the fluid dispensing system includes fluid dispensing cartridge 100 having fluid reservoir 102 formed by housing 104. Housing 104 is in fluid communication with metering chamber 110. In some embodiments, housing 104 may optionally include pressure valve 134 that allows pressure inside housing 104 to equalize to the ambient air pressure. In particular, pressure valve 134 may be used to stabilize pressure within housing 104 so that a vacuum is not formed within housing 104 after a portion of the fluid within housing 104 is dispensed. Pressure valve 134 may be any valve that allows air to enter housing 104. For example, pressure valve 134 may be a one-way "duck bill" type check valve. In other embodiments, pressure valve 134 may be omitted and a seam formed by joining first portion 104A and second portion 104B of housing 104 as previously discussed in reference to FIG. 1A may be used to vent the system.

In some embodiments, a fluid within fluid reservoir 102 is held within fluid bladder or liner 106. Bladder 106 may be positioned within the interior chamber defined by housing 104. Bladder 106 may contain a predetermined amount of a fluid (e.g., reagent or a rinsing fluid) therein. Bladder 106 may be expandable such that it expands to conform to the dimensions of the interior chamber of housing 104. In this aspect, a maximum amount of fluid may be held within bladder 106 and in turn, housing 104. It should be appreciated that bladder 106 may be made of any suitable material that is substantially fluid impermeable and is flexible. Bladder 106 may be, for example, a bladder such as that available from TechFlex Packaging, LLC of Hawthorne, Calif. under model number TF-480.

Bladder 106 assists with reducing ambient air contamination and extending the shelf life of the fluid contained in it. In some embodiments, bladder 106 includes pleats to facilitate expansion of bladder 106 from a collapsed to an expanded configuration. Bladder 106 may have a quadrilateral cross section in the expanded configuration. For example, in embodiments where housing 104 has a trapezoidal cross section, bladder 106 may also have a trapezoidal cross section in the expanded configuration. In other embodiments, bladder 106 may have any dimensions suitable for holding the desired amount of fluid, for example, an elliptical cross section. Bladder 106 will be described in further detail in reference to FIG. 13.

Bladder 106 may be coupled to metering chamber 110 via connector 108. Connector 108 may be a substantially rigid member having cylindrical conduit 112 therethrough. Connector 108 may be made of any material suitable for holding liquid such as a chemically inert plastic, for example polyethylene or polypropylene. In this aspect, fluid from bladder 106 flows through connector 108 and into metering chamber 110. One end of connector 108 may be sealed (e.g. heat sealed) to bladder 106 at an opening formed at an end of bladder 106. An opposite end of connector 108 may be inserted within an end of metering chamber 110 and through opening 114 formed through a base portion of housing 104.

Connector 108 may include upper portion 154 and lower portion 158. Bladder 106 is sealed around upper portion 154. Lower portion 158 is inserted within metering chamber 110. Upper portion 154 provides a first flange to help secure upper portion 154 within bladder 106. As illustrated in FIG. 1B, first flange formed by upper portion 154 is positioned within bladder 106 and the opening of bladder 106 is sealed around the first flange.

Lower portion 158 includes second flange 156 and third flange 160. Second flange 156 is positioned along an exterior surface of bladder 106 opposite the first flange. Third flange 158 is positioned at an end of lower portion 158 positioned within metering chamber 110.

In some embodiments, collar 116 may further be positioned at opening 114 to ensure a fluid tight seal between connector 108 and metering chamber 110. Collar 116 may be a ring shaped structure positioned within opening 114 and outside of metering chamber 110. Collar 116 is dimensioned to secure metering chamber 110 to connector 108 and prevent any gaps between the two structures. In this aspect, collar 116 may have a diameter small enough to fit within opening 114 and yet large enough to fit around metering chamber 110 to clamp or seal the end of metering chamber 110 to connector 108. In some embodiments, collar 116 may be made of a same or different material as connector 108, for example, a chemically inert plastic.

Collar 116 may include annular ring 162 formed around an inner surface of collar 116. Ring 162 is positioned slightly above third flange 160 of connector 108 (as viewed) so that it pinches a portion of metering chamber 110 between ring 162 and third flange 160. This configuration helps to secure metering chamber 110 around connector 108 and prevent metering chamber 110 from separating from connector 108 and, in turn, housing 104.

Collar 116 may further include annular groove 164 formed around an upper edge of collar 116. Annular groove 164 is dimensioned to receive upper flange 166 extending from an upper portion of metering chamber 110. Positioning of upper flange 166 within annular groove 164 further helps to inhibit separation of metering chamber 110 from housing 104.

Metering chamber 110 may be a fluid reservoir configured to hold fluid therein. In this aspect, metering chamber 110 provides a holding space for a predetermined volume of fluid that has passed from bladder 106 within fluid reservoir 102 into metering chamber 110 prior to being ejected from cartridge 100. Metering chamber 110 may be any desired size or shape. Metering chamber 110 may have a volume that is larger than the volume dispensed during each dispensing cycle of cartridge 100. In some embodiments, metering chamber 110 holds a volume of from about 1.5 ml to 4 ml. Representatively, metering chamber 110 may be a tubular structure having a diameter of from about 0.25 inches to about 1.25 inches, a length of about 2 inches to about 3 inches and hold a volume of from about 1.5 ml to 4 ml. According to this embodiment, a volume of about 5 μl to about 400 μl±5 μl may be dispensed from metering chamber 110 during each ejection cycle.

Metering chamber 110 may extend from housing 104 and provide a conduit for fluid to travel from bladder 106 to an underlying sample. In one embodiment, metering chamber 110 may be a cylindrical member, for example a tubular structure. In one embodiment, metering chamber 110 may be a tubular structure having substantially the same diameter along its length. In other embodiments, metering chamber 110 may be a tubular structure that is tapered in shape. Metering chamber 110 may further include upper flange 166 and lower flange 168 to facilitate attachment of chamber 110 to housing 104 and nozzle 120 respectively.

In one embodiment, to secure metering chamber 110 to housing, metering chamber 110 may be inserted into opening 114 at the end of housing 104 and around connector 108 extending through opening 114. As previously discussed, upper flange 166 of metering chamber 110 is positioned within annular groove 164 of connector 108 to help secure metering chamber 110 to housing 104. Collar 116 may further be placed around metering chamber 110 to ensure a fluid tight seal between metering chamber 110 and connector 108.

Metering chamber 110 may be made of a substantially flexible or compressible material. Preferably, the material of metering chamber 110 is a material which minimizes chemical permeability and returns to an original shape after compression. Representatively, metering chamber 110 may be made of a material such as silicone, polyvinyl chloride (PVC) or the like. In this aspect, metering chamber 110 may be deformed between a rest and an eject position. In the rest position, a fluid may be contained within metering chamber 110. Application of a compressive force to metering chamber 110 compresses metering chamber 110 causing the fluid within metering chamber 110 to be ejected out an opening in the end of metering chamber 110. The amount of stroke of a compression mechanism applying the compressive force may be used to control the volume of fluid ejected. In some embodiments, the dispense volume may be adjustable. In other embodiments, the dispense volume may be fixed.

The flow of fluid from metering chamber 110 is regulated by valve 118. Valve 118 is located generally at the end of metering chamber 110. Valve 118 may be a liquid retention valve. Representatively, valve 118 may have deformable flaps that seal against each other when the valve is closed and separate from each other to form a gap when the valve is opened. When metering chamber 110 is in a rest position, valve 118 remains closed and retains fluid within metering chamber 110. When metering chamber is in an eject position (i.e. compressed), valve 118 opens. The pressure created within metering chamber 110 due to the compressive force causes the fluid to be ejected out of open valve 118. In some embodiments, valve 118 is integrally formed at an end of metering chamber 110. In this aspect, valve 118 is made of the same material as metering chamber 110. In other embodiments, valve 118 is a separate piece which is attached (e.g. glued or heat sealed) to an open end of metering chamber 110 and may be made of the same or different material than metering chamber 110. Valve 118 will be discussed in further detail in reference to FIGS. 2-5.

Nozzle 120 may be positioned at an end of metering chamber 110 such that a fluid from valve 118 passes through nozzle 120 before exiting cartridge 100. Nozzle 120 is used to control a direction and/or velocity of fluid flowing from metering chamber 110 out of cartridge 100. In this aspect, nozzle 120 may include reservoir 122 dimensioned to receive an end of metering chamber 110. Nozzle 120 may further include fluid conduit 132 extending between reservoir 122 and opening 124 at an end of nozzle 120. The dimensions of fluid conduit 132 and opening 124 may be selected to control a direction of fluid flow and/or velocity of fluid ejected through valve 118. Representatively, fluid conduit 132 may have a length and width dimension and opening 124 may have a width dimension selected to control a direction of fluid flow and a velocity of fluid ejection.

In one embodiment, opening 124 may be defined by counter bore 170 formed at the end portion of fluid conduit 132. In this aspect, opening 124 may have a width dimension greater than a width of fluid conduit 132. Formation of counter bore 170 within the end portion of fluid conduit 132 helps to prevent excess fluid not dispensed onto an underlying sample from remaining along an outer surface of nozzle 120. In particular, fluid which would normally collect on an outer surface of nozzle 120 instead remains within counter bore 170. When fluid remains on an outer surface of nozzle 120, it is not dispensed onto the sample. This causes the actual volume of fluid dispensed onto the sample to be less than the intended volume and can affect sample treatment. Counter bore 170 allows for this excess fluid to be captured within nozzle 120 and dispensed during the next dispensing cycle. Thus, a volume of fluid is dispensed more accurately from cartridge 100.

When nozzle 120 is positioned around metering chamber 110, flange 168 extending from metering chamber 110 rests along the top edge of nozzle 120. Nozzle locking mechanism 134, which encircles metering chamber 110, is then placed on a side of flange 168 opposite nozzle 120. Arms of nozzle locking mechanism 134 extend beyond flange 168 toward nozzle 120 and are inserted within nozzle 120 to lock nozzle 120 to metering chamber 110.

In some embodiments, in addition to nozzle locking mechanism 134, an adhesive, glue or hot-melt process may be used to secure nozzle 120 to metering chamber 110. In some embodiments, an outer surface of the end of metering chamber 110 and an inner surface of nozzle 120 may have complimentary ribbing or threading such that nozzle 120 is screwed around an end of metering chamber 110. In other embodiments, nozzle 120 may be integrally formed with the end of metering chamber 110. Nozzle 120 is described in further detail in reference to FIG. 2.

Fluid may be ejected from metering chamber 110 through valve 118 and nozzle 120 by squeezing metering chamber 110. In one embodiment, compression assembly 126 coupled to metering chamber 110 squeezes metering chamber 110. Although specific compression assemblies are disclosed herein, it is contemplated that compression assembly 126 may be any type of compressive device which squeezes metering chamber 110 starting at the top end (i.e. end closest to reservoir 102) and moving down to the bottom end (i.e. end furthest from reservoir 102). In this aspect, fluid is prevented from flowing past compression assembly 126 and back toward fluid reservoir 102. Since fluid is prevented from flowing past compression assembly 126 during the ejection cycle, a second valve at a proximal end of metering chamber 110 (i.e. end closest to reservoir 102) to prevent fluid backflow into fluid reservoir 102 is unnecessary. In this aspect, a fluid conduit 112 of connector 108 positioned within metering chamber 110 is unopposed by, for example, a valve, and allows for unobstructed fluid flow from reservoir 102 into metering chamber 110. Additional valves may, however, be included at each end of metering chamber 110 if desired.

Compression assembly 126 may include compression members 128 and 130. Compression members 128 and 130 may be of any size and shape suitable for compressing metering chamber 110. Representatively, in one embodiment, compression members 128 and 130 are elongated plate like structures such as those illustrated in FIG. 1B. In other embodiments, compression members 128 and 130 may be, for example, rollers. Compression members 128 and 130 may be positioned on opposite sides of metering chamber 110 and be movable in a horizontal (i.e. a direction toward metering chamber 110). In some embodiments, compression members 128 and 130 may further move in a vertical direction along a length of metering chamber 110. Compression members 128 and 130 may be driven in the desired direction by, for example, a rotary cam or gear mechanism. In other embodiments, movement of compression members 128 and 130 may be driven by a spring and piston assembly. Although movement of both compression members is described, it is further contemplated that in some embodiments only one of compression members 128 and 130 may move while the other remains stationary.

To compress metering chamber 110, compression members 128 and 130 may be advanced toward one another in a direction of metering chamber 110. Compression members 128, 130 compress (i.e. squeeze) metering chamber 110 along its length causing valve 118 to open and a predetermined amount of fluid to be ejected there from. Upon ejection of the predetermined amount of fluid, compression members 128 and 130 may be released allowing metering chamber 110 to return to its original configuration. Expansion of metering chamber 110 back to its original, resting configuration creates an initial vacuum within metering chamber 110 which draws the "last drop" hanging on the end of nozzle 120 back into counter bore 170 of nozzle 120 for ejection during the next cycle. The phrase "last drop" as used herein refers to an amount of fluid which, due to the surface tension of the liquid, forms a drop and remains at the end of nozzle 120 after the rest of the fluid is ejected. The presence or absence of the last drop from the ejected fluid changes the amount of fluid applied to the underlying sample. It is therefore important that the last drop be accounted for by either ensuring that it is ejected with the initial amount of fluid or drawn back into the metering chamber and ejected with the next amount of fluid applied to the sample.

Figure 2:
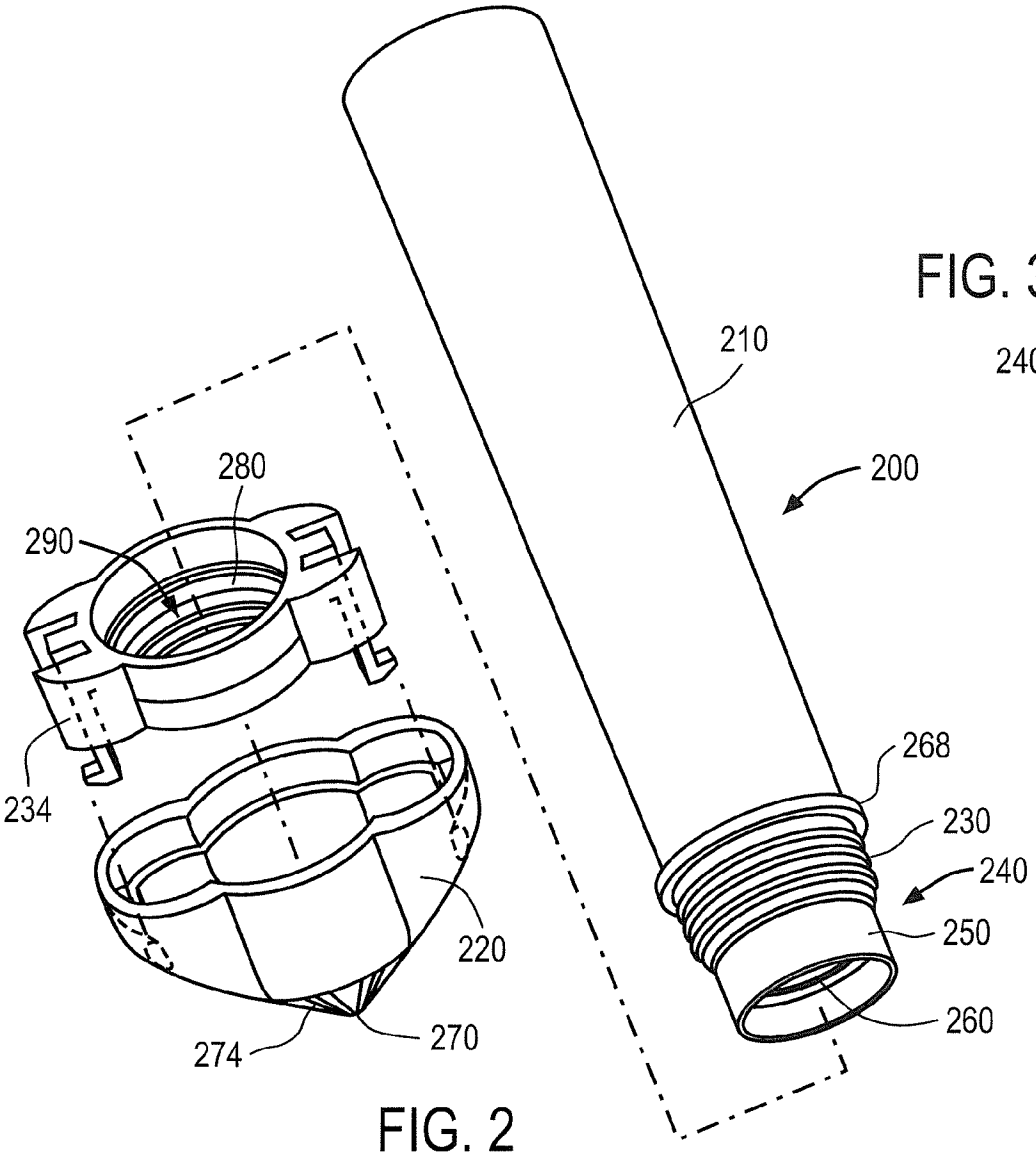
FIG. 2 illustrates an exploded view of one embodiment of a fluid dispensing system.

FIG. 2 illustrates an exploded view of one embodiment of a fluid dispensing system including a metering chamber. Metering chamber 200 includes tubular portion 210. Valve 240 is positioned at an end of tubular portion 210. Valve 240 may be constructed of cylindrical skirt member 250 circumferentially disposed around base member 260. Cylindrical skirt member 250 may extend from an end of tubular portion 210. Base member 260 may be formed across skirt member 250. An opening (see FIGS. 3-5) of valve 240 may be formed through base member 260.

In some embodiments, metering chamber 200 further includes ribbing 230 formed around an outer surface of tubular portion 210 to facilitate attachment of nozzle 220. Representatively, ribbing 230 may be formed around an end portion of tubular portion 210. An inner surface of nozzle 220 may include ribbing 280 complimentary to ribbing 230. Nozzle 220 may be attached to tubular portion 210 by positioning the end of tubular portion 210 having valve 240 within reservoir 290 of nozzle 220 and positioning ribbing 280 of nozzle 220 between ribbing 230 of valve 240.

Once nozzle 220 is positioned around valve 240 as previously discussed, nozzle locking mechanism 234, which is positioned around tubular portion 210, may be pushed down tubular portion 210 and into slots within nozzle 220 to lock nozzle 220 to tubular portion 210. As previously discussed, flange 268 extending from tubular portion 210 may be positioned between nozzle 220 and nozzle locking mechanism 234. In still further embodiments, nozzle 220 may be secured to tubular portion 210 by an adhesive, glue or hot melt. When nozzle 220 is attached to tubular portion 210, fluid ejected from tubular portion 210 flows out of nozzle 220 through opening 270.

When tubular portion 210 of metering chamber 200 is compressed, valve 240 opens deflecting skirt member 250 outward. This deflection of skirt member 250 causes skirt member 250 to press against the adjacent surface of nozzle 220. In this aspect, skirt member 250 creates a seal between skirt member 250 and nozzle 220 which prevents any fluid from flowing back up along the sides of nozzle 220. Instead, any fluid back up is contained within a region of nozzle 220 defined by skirt 250. Such feature is important to ensuring that an accurate amount of fluid is delivered to the sample. In particular, if during dispensing of the fluid, the fluid were to escape out of the sides of nozzle 220, the amount of fluid dispensed would actually be less than that which is expected. Sealing of skirt member 250 against nozzle 220 will be discussed in more detail in reference to FIG. 6 and FIGS. 7A-7D.

Figure 3:
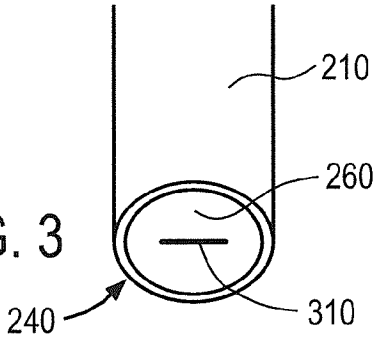
FIG. 3 illustrates a perspective view of one embodiment of the fluid dispensing system of FIG. 2.
Figure 4:
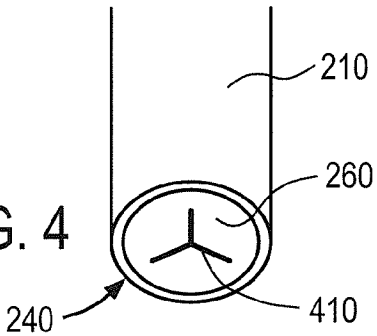
FIG. 4 illustrates a perspective view of one embodiment of the fluid dispensing system of FIG. 2.
Figure 5:
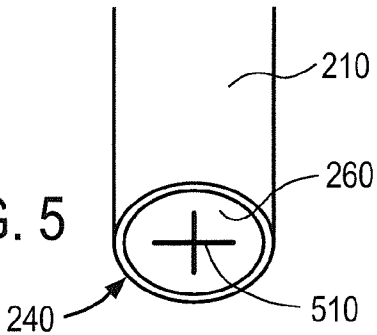
FIG. 5 illustrates a perspective view of one embodiment of the fluid dispensing system of FIG. 2.

FIG. 3, FIG. 4. and FIG. 5 illustrate various embodiments of a valve. FIG. 3 illustrates tubular portion 210 of metering chamber 200 including valve 240 having base member 260. Valve 240 includes opening 310 formed through base member 260. In this embodiment, opening 310 is in the shape of a slit. In this aspect, when tubular portion 210 of metering chamber 200 is compressed, the valve flaps forming slit 310 open allowing for ejection of a fluid held within tubular portion 210.

FIG. 4 includes the same structures as FIG. 3 except that in this embodiment, opening 410 is a "Y" shaped opening. Similar to valve 240 of FIG. 3, when tubular portion 210 of metering chamber 200 is compressed, the valve flaps forming the "Y" shaped opening 410 open allowing for ejection of a fluid held within tubular portion 210.

FIG. 5 includes the same structures as FIG. 3 and FIG. 4 except that in this embodiment, opening 510 is a cross shaped opening. Similar to valve 240 of FIG. 3 and FIG. 4, when tubular portion 210 of metering chamber 200 is compressed, the valve flaps forming cross shaped opening 510 open allowing for ejection of a fluid held within tubular portion 210.

Figure 6:
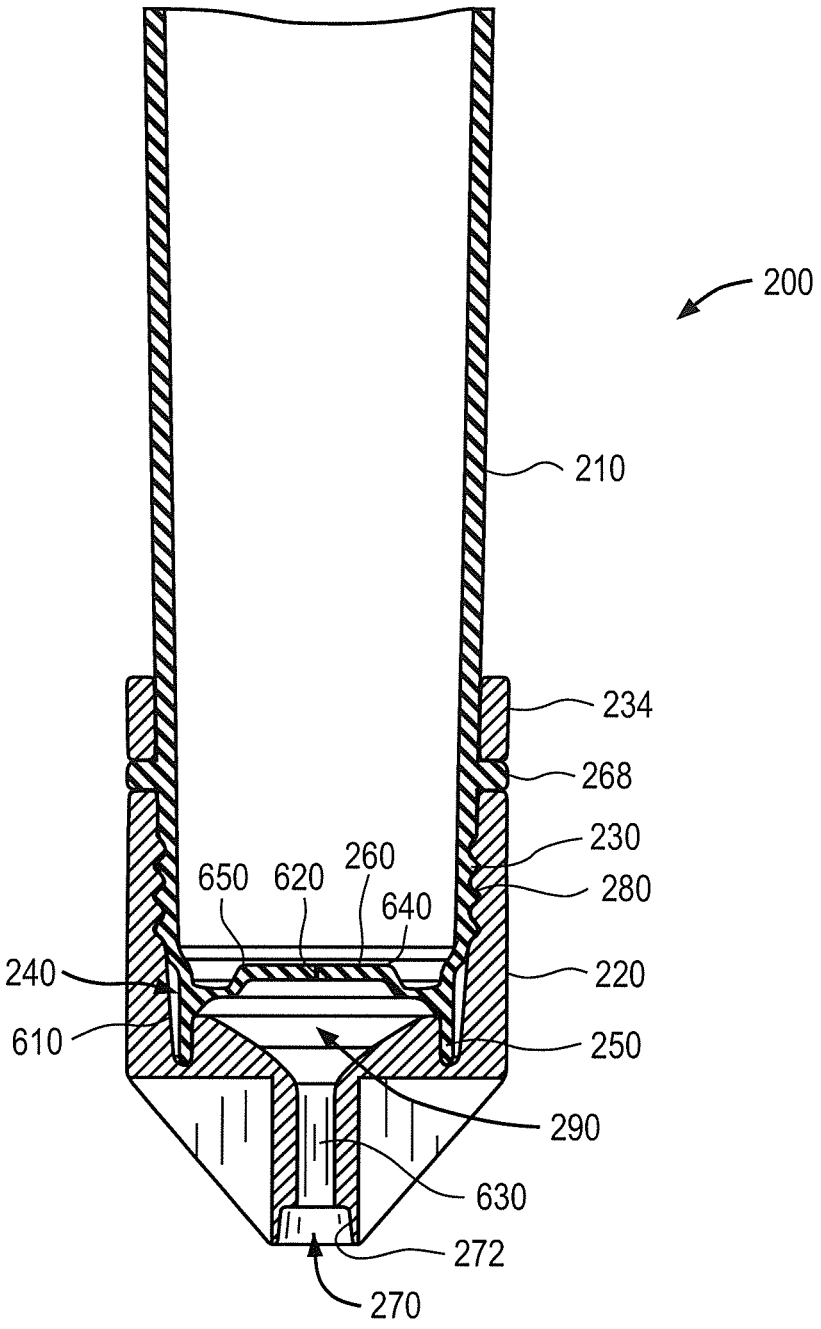
FIG. 6 illustrates a cross-sectional view of the fluid dispensing system of FIG. 2.

FIG. 6 illustrates a cross-sectional view of the metering chamber of FIG. 2. In this embodiment, tubular portion 210 of metering chamber 200 is shown attached to nozzle 220. Tubular portion 210 may be attached to nozzle 220 by ribbing 230 and 280 and nozzle locking mechanism 234. Valve 240 is positioned within nozzle 220. Valve 240 includes base member 260 and skirt member 250. Base member 260 includes flaps 640, 650 which are split at region 620 to define an opening when metering chamber 200 is compressed.

Skirt member 250 is positioned within recessed region 610 of nozzle 220. As can be seen from FIG. 6, recessed region 610 is an annular chamber formed within reservoir 290 of nozzle 220. Skirt member 250 rests within recessed region 610 and may be sealed to opposing sides of recessed region 610 depending upon whether skirt member 250 is in a non-deflected or deflected configuration. FIG. 6 illustrates skirt member 250 in a non-deflected state (i.e., valve 240 is in a closed configuration). When skirt member 250 is in a deflected state, flaps 640, 650 open and skirt 250 deflects and seals to an opposite surface of recessed region 610. A fluid may then be ejected out of tubular portion 210 through slit 620 along channel 630 leading to opening 270 of nozzle 220 and out of nozzle 220. As previously discussed, the portion of nozzle 220 forming opening 270 includes counter bore 272 for retaining any non-dispensed fluids within nozzle 220.

FIGS. 7A-7D illustrate a cross sectional view of the fluid dispensing system of FIG. 2 during operation. In particular, a transition of metering chamber 200 between a rest and an eject position is illustrated. Metering chamber 200 is substantially the same as the metering chamber disclosed in reference to FIG. 6. In this aspect, metering chamber 200 includes tubular portion 210, valve 240 and nozzle 220. Valve 240 includes base member 260 having flaps 640, 650 which split at region 620 to form an opening or slit and skirt member 250. Skirt member 250 is positioned within recessed portion 610 of nozzle 220. Tubular portion 210 includes ribbing 230 complimentary to ribbing 280 of nozzle 220 to facilitate attachment of nozzle 220 to tubular portion 210.

Figure 7A:
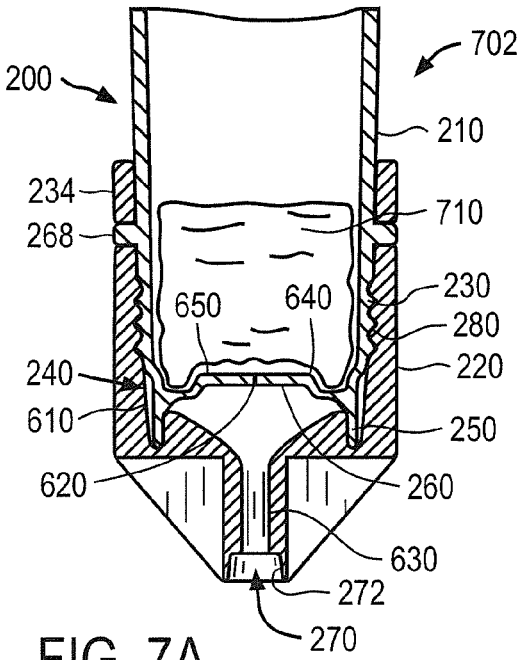
FIG. 7A illustrates a cross-sectional view of the fluid dispensing system of FIG. 2 during operation.

FIG. 7A illustrates metering chamber 200 in a rest position. As can be seen from FIG. 7A, in the rest position, slit 620 of valve 240 is in a closed position. In addition, skirt member 250 is in a non-deflected state. In this aspect, skirt member 250 rests along an inner surface of the portion of nozzle 220 defining recessed portion 610. Since slit 620 is in a closed position, fluid 710 is held within tubular portion 210.

Figure 7B:
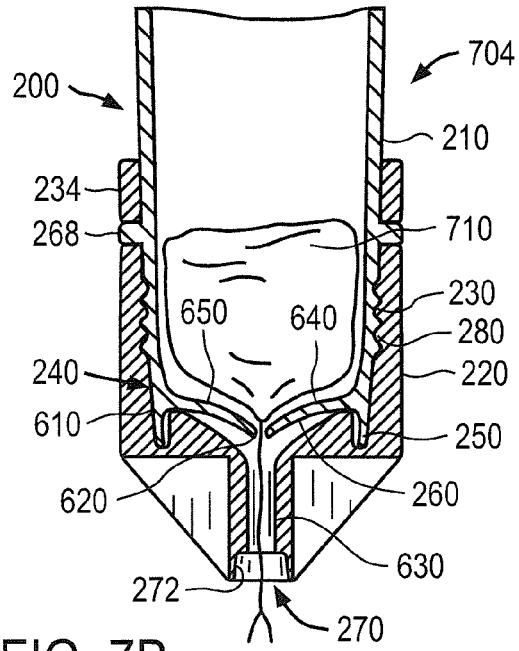
FIG. 7B illustrates a cross-sectional view of the fluid dispensing system of FIG. 2 during operation.

FIG. 7B illustrates metering chamber 200 in an eject position. In this aspect, tubular portion 210 has been compressed. As previously discussed, compression of tubular portion causes slit 620 to open. Fluid 710 is then ejected out of tubular portion 210 through slit 620 along channel 630 leading to opening 270 of nozzle 220 and out of nozzle 220. Opening of valve 240 deflects skirt member 250 toward an outer surface of the portion of nozzle 220 defining recessed portion 610. Deflection of skirt member 250 effectively seals skirt member 250 against recessed portion 610 and prevents fluid from flowing up nozzle 220 between the sides of tubular portion 210 and nozzle 220.

Figure 7C:
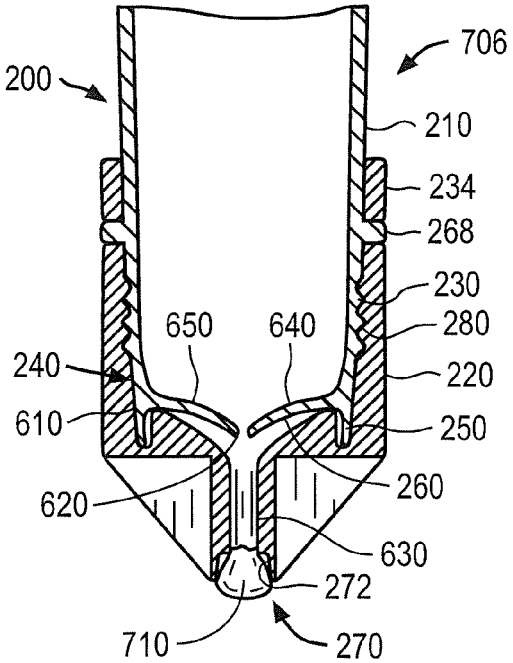
FIG. 7C illustrates a cross-sectional view of the fluid dispensing system of FIG. 2 during operation.

FIG. 7C illustrates metering chamber 200 in an eject position after the desired amount of fluid is ejected. In this aspect, tubular portion 210 has been compressed and the desired amount of fluid has been ejected out of metering chamber 200 through opening 270 of nozzle 220. A last drop of fluid 710, however, remains attached to the end of nozzle 220. It is desired that the last drop be sucked back into nozzle 220 and ejected with the next fluid ejection cycle.

Figure 7D:
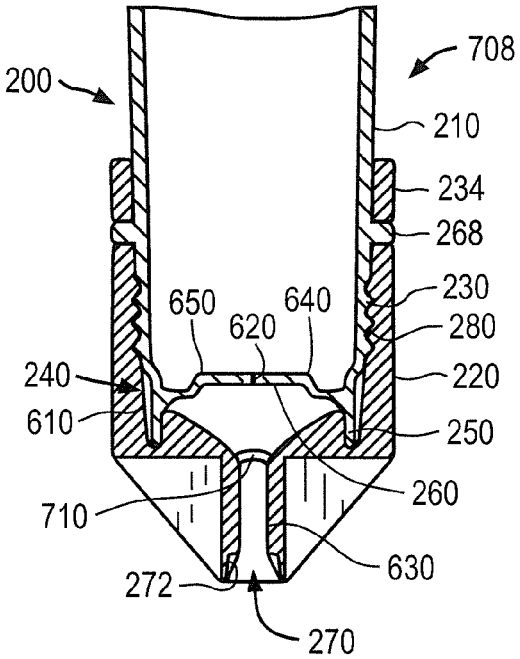
FIG. 7D illustrates a cross-sectional view of the fluid dispensing system of FIG. 2 during operation.

FIG. 7D illustrates an embodiment in which valve 240 has returned to the rest position. As can be seen from a comparison of FIGS. 7C and 7D, base member 260 transitions from a substantially convex configuration in the eject position of FIG. 7C to a substantially concave configuration in the rest position of FIG. 7D. This transition creates a vacuum within the area between nozzle 220 and base member 260. This vacuum effect draws the last drop of fluid 710 back into nozzle 220. Last drop 710 then remains within channel 630 or counter bore 272 of nozzle 220 as shown in FIG. 7D until the next fluid ejection cycle. FIG. 7D further illustrates skirt member 250 returning to the non-deflected configuration once valve 240 returns to the rest position. In the non-deflected configuration, skirt member 250 rests along an inner surface of the portion of nozzle 220 forming recess portion 610.

Figure 8:
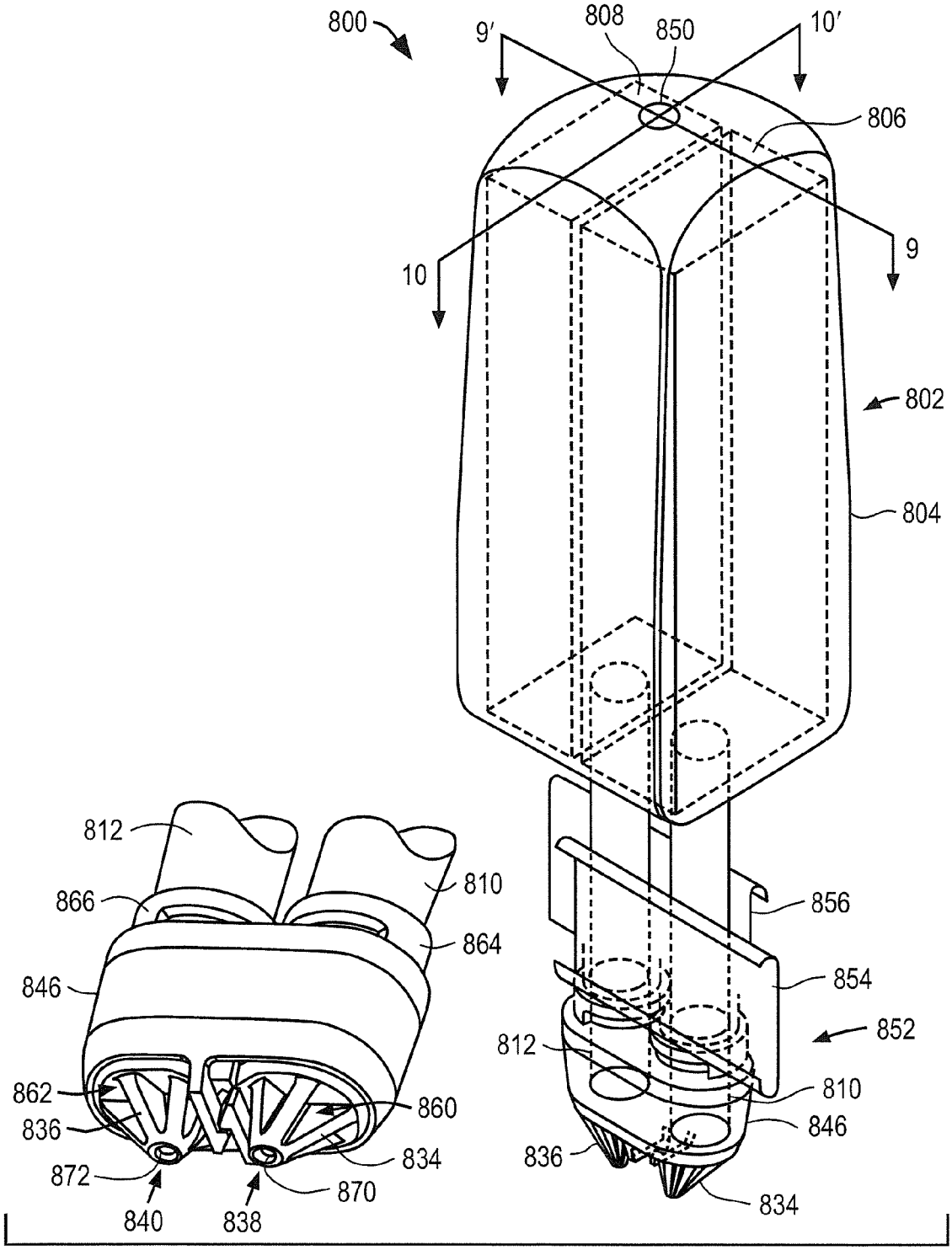
FIG. 8 illustrates a cross-sectional view of another embodiment of a fluid dispensing system.
Figure 9:
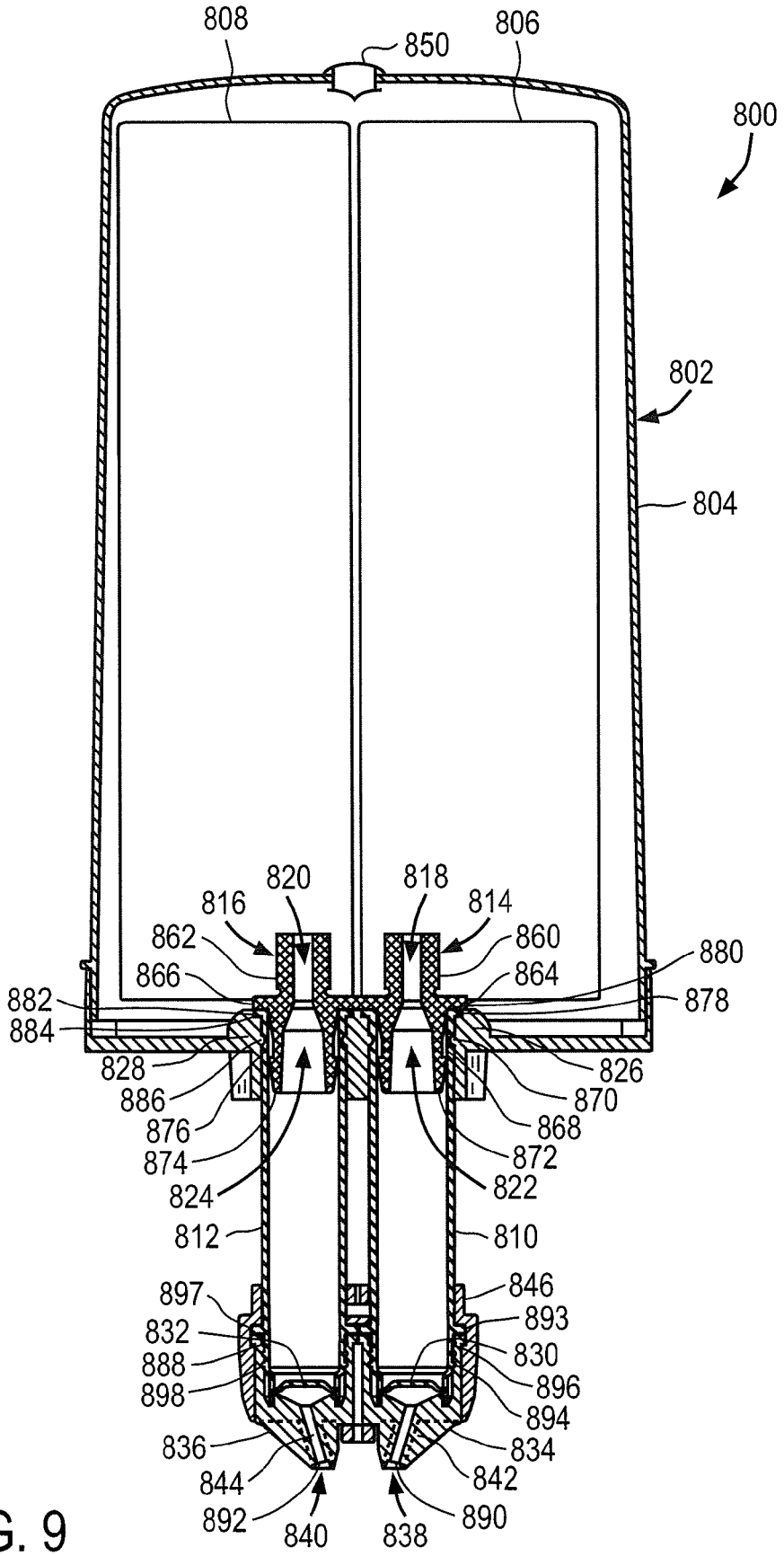
FIG. 9 illustrates a cross-sectional view of the fluid dispensing system of FIG. 8 along line 9-9'.
Figure 10:
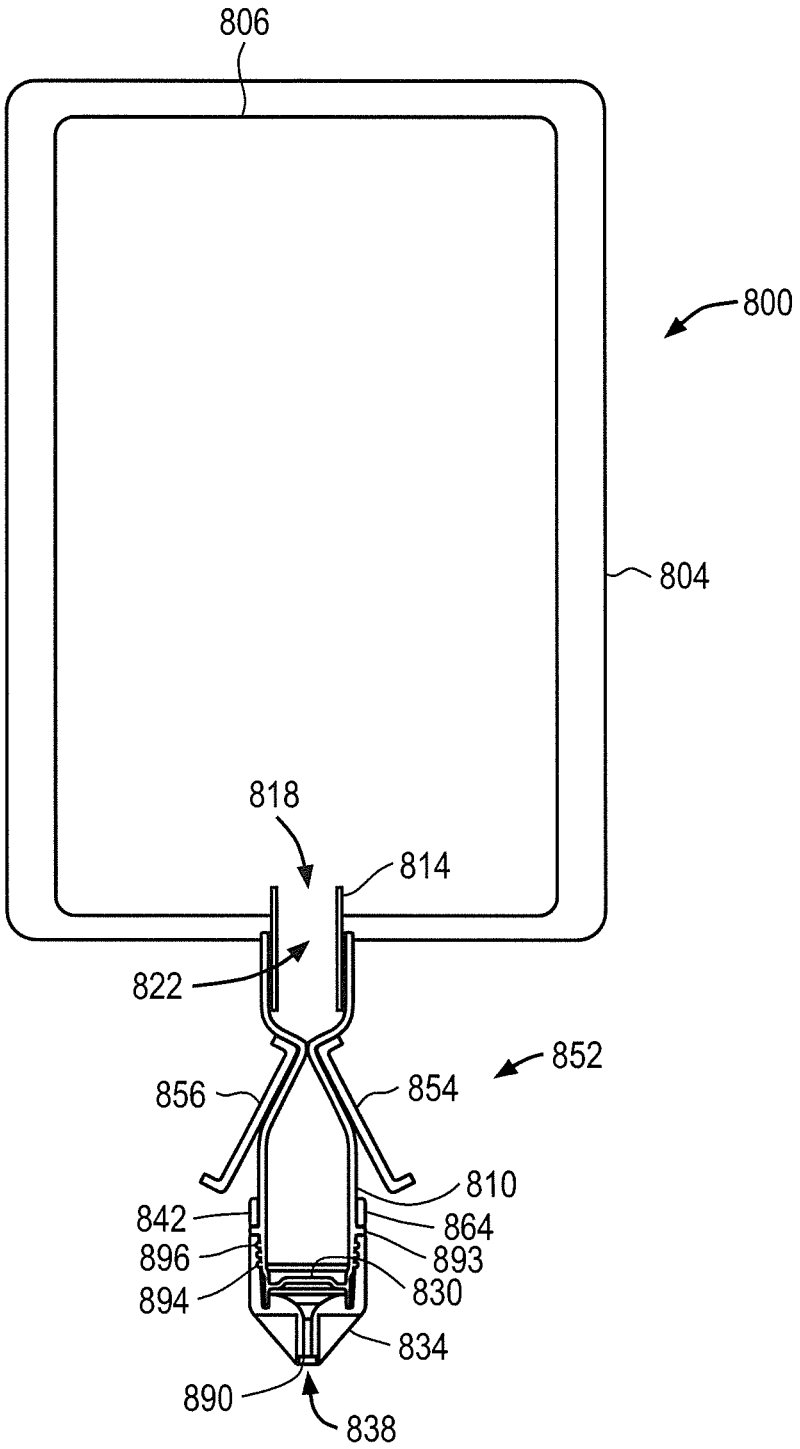
FIG. 10 illustrates a cross-sectional view of the fluid dispensing system of FIG. 8 along line 10-10'.

FIG. 8, FIG. 9 and FIG. 10 illustrate various views of a fluid dispensing system including a fluid dispensing cartridge having two metering chambers. In particular, FIG. 8 illustrates a perspective view of one embodiment of a fluid dispensing system including a fluid dispensing cartridge having two metering chambers. FIG. 9 illustrates a cross sectional view of the fluid dispensing system of FIG. 8 along line 9-9'. FIG. 10 illustrates a cross sectional view of the fluid dispensing system of FIG. 8 along line 10-10'.

Fluid dispensing cartridge 800 generally includes fluid reservoir 802 that is in fluid communication with metering chambers 810 and 812. Fluid reservoir 802 is generally a container that is configured to hold a predetermined amount of a fluid, such as a reagent or a rinsing fluid. In some embodiments, reservoir 802 includes housing 804. Housing 804 may be a rigid housing that is constructed from a fluid impermeable material similar to housing 104 discussed in reference to FIG. 1B. Representatively, housing 804 may be constructed from any material suitable for holding liquid such as a chemically inert plastic, for example polyethylene or polypropylene. In addition to containing a fluid, housing 804 may provide a grasping surface for handling and a marking surface so information may be recorded on the cartridge, for example, by writing on the surface or affixing a label. The label may be, for example, a bar code or RFID which identifies the contents of reservoir 802 and/or a processing protocol.

In some embodiments, housing 804 may be a clam shell type housing similar to housing 104 discussed in reference to FIG. 1B. The seam created where each of the sides of housing 804 meet may allow air to pass through it to facilitate equalization of pressure within housing 804. In particular, the gaps at the seam may be used to stabilize pressure within housing 804 so that a vacuum is not formed within housing 804 after a portion of the fluid within housing 804 is dispensed. In some embodiments, housing 804 may optionally include pressure valve 850 that allows pressure inside housing 804 to equalize to the ambient air pressure. Pressure valve 850 may be substantially the same as pressure valve 134 discussed in reference to FIG. 1B. Pressure valve 850 may be any valve that allows air to enter housing 804. For example, pressure valve 850 may be a one-way "duck bill" type check valve.

Housing 804 may be dimensioned to accommodate fluid bladder 806 and fluid bladder 808. Bladders 806, 808 may be positioned within the interior chamber defined by housing 804. In some embodiments, bladders 806, 808 are positioned side by side within housing 804. In other embodiments, housing 804 may include a wall dividing the interior chamber into two chambers in order to separate bladders 806, 808.

Bladders 806, 808 may contain a predetermined amount of a fluid (e.g., reagent or a rinsing fluid) therein. The fluids contained in bladders 806, 808 may be the same or different. For example, in some embodiments, it may be desirable to use two different fluids which must be kept separate prior to application to a sample. In this aspect, one of the fluids may be contained in bladder 806 and the other fluid in bladder 808. The fluids will not mix until they are ejected from metering chambers 810, 812 coupled to bladders 806, 808, respectively.

Bladders 806, 808 may be expandable. Bladders 806, 808 may expand to conform to the dimensions of the interior chamber of housing 804. In this aspect, a maximum amount of fluid may be held within bladders 806, 808 and in turn, housing 804. It should be appreciated that bladders 806, 808 may be made of any suitable material that is substantially fluid impermeable and is flexible. Bladder 106 may be, for example, a bladder such as that available from TechFlex Packaging, LLC of Hawthorne, Calif. under model number TF-480. Use of bladders 806, 808 may assist with reducing ambient air contamination and extending the shelf life of the fluid contained in it.

In some embodiments, bladders 806, 808 include pleats to facilitate expansion of bladders 806, 808 from a collapsed to an expanded configuration. Bladders 806, 808 may have a quadrilateral cross section in the expanded configuration. For example, in embodiments where housing 804 has a trapezoidal cross section or an elliptical cross section, bladders 806, 808 may also have a trapezoidal cross section in the expanded configuration such that the two bladders combined conform to the internal dimensions of housing 804. It is contemplated that bladders 806, 808 may have the same or different dimensions. Bladders 806, 808 may be in fluid communication with metering chambers 810, 812, respectively.

Nozzles 834 and 836 may be positioned around ends of metering chambers 810, 812, respectively. Similar to nozzle 120 described in reference to FIG. 1A and FIG. 1B, nozzles 834, 836 may have counter bores 870, 872 formed at openings 838, 840 and cut outs 860, 862. In some embodiments, nozzle locking mechanisms 864, 866 similar to nozzle locking mechanism 134 or 234 described in reference to FIG. 1A and FIG. 2 may encircle metering chambers 810, 812 respectively, and lock nozzles 834, 836 to metering chambers 810, 812. In still further embodiments, stabilizer 846 may be positioned around nozzles 834, 836 to provide additional support to metering chambers 810, 812.

Compression assembly 852 may be coupled to metering chambers 810, 812 to facilitate fluid ejection. Compression assembly 852 may include compression members 854, 856 similar to those described in reference to FIG. 1B. In this embodiment, compression members 854, 856 are dimensioned to simultaneously compress metering chambers 810, 812 without pressing the chambers together. Representatively, compression members 854, 856 have a width dimension at least as wide as each of metering chambers 810, 812 and a distance in between metering chambers 810, 812. In this aspect, compression member 854 is positioned adjacent one side of metering chambers 810, 812 and compression member 856 is positioned adjacent an opposite side of metering chambers 810, 812. When compression members 854, 856 are pressed together, they compress each of metering chambers 810, 812 without pressing them together. Compression members 854, 856 may be driven in the desired direction by a rotary cam or gear mechanism coupled to compression members 854, 856. In other embodiments, movement of compression members 854, 856 may be driven by a spring and piston assembly. Compression of metering chambers 810, 812 using compression assembly 852 may be carried out as previously described in reference to FIG. 1B.

As illustrated in FIG. 9, bladders 806, 808 may be coupled to metering chambers 810, 812 using similar connecting components as those described in reference to FIG. 1B. In particular, an end of connectors 814, 816 having cylindrical conduits 818, 820 there through may be inserted within ends of metering chambers 810, 812. Opposite ends of connectors 814, 816 may be sealed (e.g. heat sealed) to bladders 806, 808, respectively. Connectors 814, 816 having ends of metering chambers 810, 812 positioned thereon, may be positioned within openings 822, 824 formed through a base portion of housing 804. In this aspect, fluid from bladders 806, 808 flows through connectors 814, 816 and into metering chambers 810, 812, respectively. Connectors 814, 816 may be cylindrical members made of substantially the same material as the connector disclosed in reference to FIG. 1B.

Connector 814 may include upper portion 860 and lower portion 868. Upper portion 860 is positioned inside of bladder 806 and lower portion 868 is inserted within metering chamber 810. Upper portion 860 provides a first flange to help secure upper portion 860 within bladder 806. As illustrated in FIG. 1B, first flange formed by upper portion 860 is positioned within bladder 806 and the opening of bladder 806 is sealed around the first flange.

Lower portion 868 includes second flange 864 and third flange 872. Second flange 864 is positioned along an exterior surface of bladder 806 opposite the first flange. Third flange 872 is positioned at an end of lower portion 868 positioned within metering chamber 810.

In some embodiments, collar 826 may further be positioned at opening 822 to ensure a fluid tight seal between connector 814 and metering chamber 810. Collar 826 may be a ring shaped structure positioned within opening 822 and outside of metering chamber 810. Collar 826 is dimensioned to secure metering chamber 810 to connector 814 and prevent any gaps between the two structures. In this aspect, collar 826 may have a diameter small enough to fit within opening 822 and yet large enough to fit around metering chamber 810 to clamp or seal the end of metering chamber 810 to connector 814. In some embodiments, collar 826 may be made of a plastic material or the like Collar 826 may include annular ring 870 formed around an inner surface of collar 826. Ring 870 is positioned between second flange 864 and third flange 872. Ring 870 catches a portion of metering chamber 810 between third flange 872 and ring 870 to prevent separation of metering chamber 810 from housing 804. Collar 826 further includes annular groove 878 formed around an upper edge of collar 826. Annular groove 878 is dimensioned to receive upper flange 880 formed by metering chamber 810. Positioning of upper flange 880 within annular groove 878 further helps to prevent separation of metering chamber 810 from housing 804.

Connector 816 may be similar to connector 814. Representatively, connector 816 may include upper portion 862 having a first flange and lower portion 876 having second flange 866 and third flange 874. Collar 828 similar to collar 826 may further be provided at opening 824 to ensure a fluid tight seal between connector 816 and metering chamber 812. Collar 828 may include annular ring 886 positioned between second flange 866 and third flange 874 to prevent separation of metering chamber 812 from housing 804. Collar 828 may further include an annular groove 882 formed around an upper edge for receiving upper flange 884 of metering chamber 810. Although collar 826 and collar 828 are described separately, it is contemplated that collars 826, 828 may be separate structures or may be integrally formed such that they are connected together.

Metering chambers 810, 812 may be substantially the same as metering chamber 110 described in reference to FIG. 1. In this aspect, metering chambers 810, 812 provide a holding space for a predetermined volume of fluid that has flown from bladders 806, 808, respectively, prior to being ejected from cartridge 800. Metering chambers 810 and 812 may be any desired size or shape. Metering chambers 810, 812 may have a volume that is larger than the volume dispensed during each dispensing cycle of cartridge 800. It is noted that in embodiments such as cartridge 800 having two metering chambers 810, 812, the total amount of fluid dispensed with each cycle may be the same as in embodiments such as cartridge 100 of FIG. 1 having a single metering chamber. In this aspect, the dimensions of metering chambers 810, 812 may be less than those of metering chamber 110 of cartridge 100 and each of metering chambers 810, 812 may hold, for example, a volume of about half that of metering chamber 110. Representatively, each of metering chambers 810, 812 may be tubular structures having a diameter of from about ⅛ inches to about 0.75 inches and a length of about 2 inches to about 3 inches. In some embodiments, each of metering chambers 810, 812 may hold a volume of about 5 μl to about 200 μl. A combined dispense volume of metering chambers 810, 812 may be between about 5 μl to about 400 μl±5 μl during each ejection cycle.

Metering chambers 810, 812 may be made of a substantially flexible or compressible material. Preferably, the material of metering chambers 810, 812 is a material which minimizes chemical permeability and returns to an original shape after compression. Representatively, metering chambers 810, 812 may be made of a material such as silicon, polyvinyl chloride (PVC) or the like. In this aspect, metering chambers 810, 812 may be deformed between a rest and an eject position. In the rest position, a fluid may be contained within metering chambers 810, 812. Application of a compressive force to metering chambers 810, 812 compresses metering chambers 810, 812 causing the fluid within metering chambers 810, 812 to be ejected out an opening in the end of metering chambers 810, 812.

Each of metering chambers 810, 812 includes valve 830, 832, respectively, to regulate fluid flow from chambers 810, 812. Valves 830, 832 may be substantially the same as, for example, valve 118 described in reference to FIG. 1B.

Nozzle 834 may be positioned at an end of metering chamber 810 around valve 830. Similarly, nozzle 836 may be positioned at an end of metering chamber 812 around valve 832. Nozzles 834, 836 are used to regulate fluid flow from metering chambers 810, 812, respectively, out of cartridge 800. Nozzles 834, 836 may be substantially similar to nozzle 120 described in reference to FIG. 1B except they may be dimensioned to direct fluids flowing through each nozzle into a common stream. In this aspect, nozzles 834, 836 may be dimensioned to receive an end of metering chambers 810, 812, respectively. Nozzles 834, 836 may include channels 842, 844 leading to openings 838, 840, respectively, for ejection of fluids. Counter bores 890, 892 may further be formed at the ends of channels 842, 844 defining openings 838, 840. Channels 842, 844 may have a length and width dimension to control a flow direction and/or velocity of fluid ejected from openings 838, 840 of valves 834 and 836, respectively. In addition, channels 842, 844 may be formed at angles within nozzle 834, 836, respectively, sufficient to direct a fluid flowing out of opening 838 toward a fluid flowing from opening 840 such that the fluid streams mix together before contacting the sample.

A fluid tight seal may be provided between nozzles 834, 836 and metering chambers 810, 812, respectively, to secure nozzles 834, 836 to metering chambers 810, 812, respectively. Representatively, nozzle 834 may be secured around the end of metering chamber 810 using an adhesive, glue or hot-melt. In some embodiments, an outer surface of metering chamber 810 may have ribbing 894 and an inner surface of nozzle 834 may have complimentary ribbing 896 that can be positioned between ribbing 894 to help secure nozzle 834 around an end portion of metering chamber 810. In other embodiments, metering chamber 810 and the inner surface of nozzle 834 have complimentary threading. In still further embodiments, nozzle 834 may be integrally formed with the end of metering chamber 810. Nozzle 836 may be attached to metering chamber 812 in a similar or different manner than that used to attach nozzle 834 to metering chamber 810. Representatively, nozzle 836 may be attached to metering chamber 812 using an adhesive and/or complimentary ribbing 888, 898 or threading as previously discussed.

In some embodiments, once nozzles 834, 836 are attached to the ends of metering chambers 810, 812 they can be attached to one another. Representatively, when nozzles 834, 836 are placed on metering chambers 810, 812, the adjacent surfaces of nozzles 834, 836 may be flat so that they can be placed next to one another without modifying a vertical position of metering chambers 810, 812. One of nozzles 834, 836 may include a protruding portion and the other of nozzles 834, 836 may include a receiving portion dimensioned to receive the protruding portion. When nozzles 834, 836 are pressed together, protruding portion is inserted into receiving portion to hold nozzles 834, 836 together. In some embodiments, each of nozzles 834, 836 may include a protruding portion and a receiving portion.

Stabilizer 846 may be connected to metering chambers 810, 812 and nozzles 834, 836. In some embodiments stabilizer 846 may be a substantially oblong shaped cylindrical structure which encircles metering chambers 810, 812 and nozzles 834, 836. Compartments may be formed within stabilizer 846 which are dimensioned to receive portions of metering chambers 810, 812 and nozzles 834, 836. In some embodiments, stabilizer 846 is a separate structure from metering chambers 810, 812 and nozzles 834, 836 which is fit around metering chambers 810, 812 and nozzles 834, 836 once they are assembled. Representatively, stabilizer 846 may include two halves which may be snap fit together around chambers 810, 812 and nozzles 834, 836. In other embodiments, nozzles 834 and 836 may be connected to and extend from one end of stabilizer 846.

Each of metering chambers 810, 812 further include lower flanges 893, 897 positioned between nozzles 834, 836 and nozzle locking mechanisms 864, 866 to help secure nozzles 834, 836 to metering chambers 810, 812.

FIG. 10 illustrates a cross sectional view of the fluid dispensing system of FIG. 8 along line 10-10'. As can be seen from this view, compression members 854, 856 may be used to compress metering chamber 810 (and metering chamber 812) to eject a volume of fluid.

Figure 11:
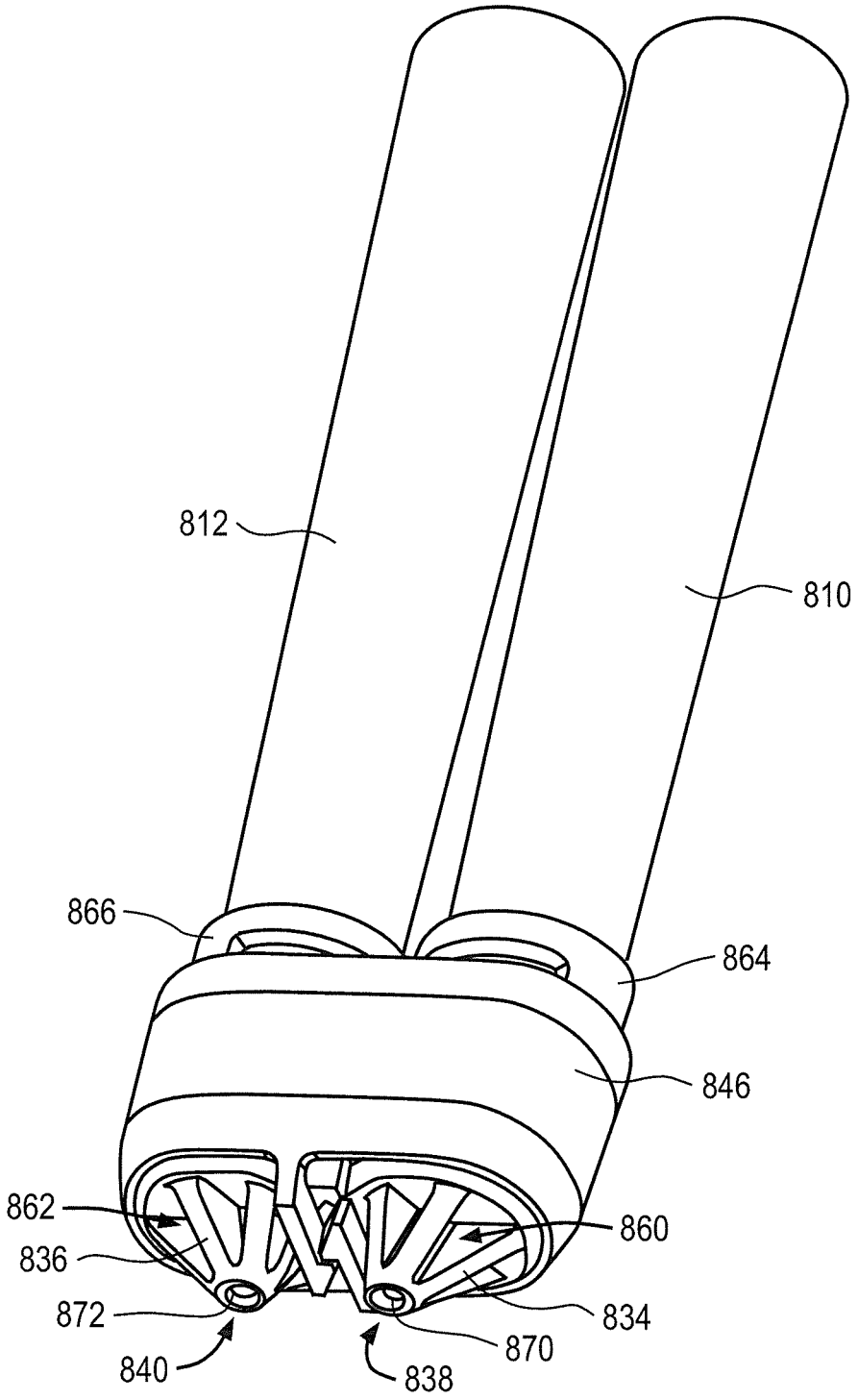
FIG. 11 illustrates a perspective view of the metering chambers of the fluid dispensing system of FIG. 8.

FIG. 11 is a perspective view of the metering chambers illustrated in FIG. 8. Metering chambers 810, 812 are shown attached to stabilizer 846 and nozzles 834, 836. As previously discussed, stabilizer 846 may have an oblong, cylindrical shape which encompasses portions of metering chambers 810, 812 and nozzles 834, 836. Nozzles 834, 836 include openings 838, 840, respectively, which direct streams of fluid flowing there through toward one another so that they mix prior to application to a sample. Nozzles 834, 836 may include counter bores 870, 872 to capture a "last drop" as previously discussed. Nozzle locking mechanisms 864, 866 may further be provided to lock nozzles 834, 836 to metering chambers 810, 812, respectively.

Figure 12:
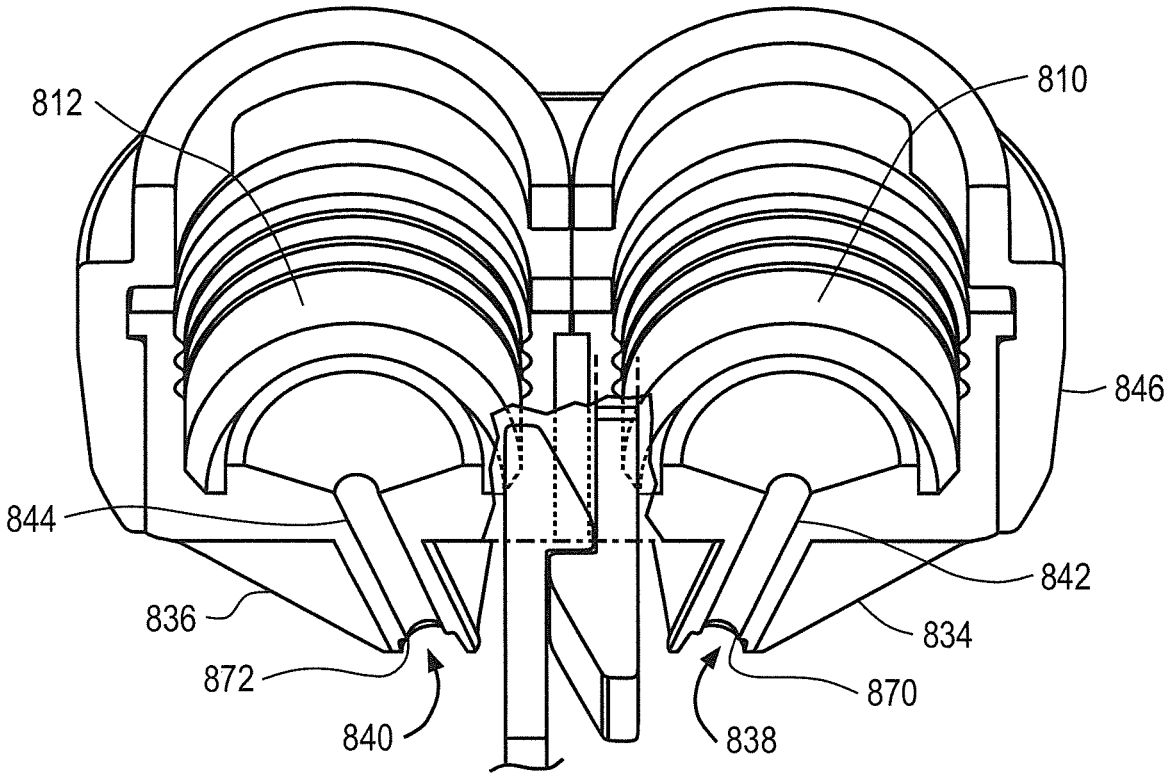
FIG. 12 illustrates a cut out view of the stabilizer illustrated in FIG. 11.

FIG. 12 illustrates a cut out view of the stabilizer illustrated in FIG. 11. Ends of metering chambers 810, 812 are shown positioned within compartments of stabilizer 846 dimensioned to receive metering chambers 810, 812 and nozzles 834, 836. Nozzles 834, 836 include channels 842, 844 for directing a fluid out openings 838, 840. As can be seen from FIG. 12, channels 842, 844 are angled toward one another so that the fluid flow is directed out openings 838, 840 and into a single stream.

Figure 13:
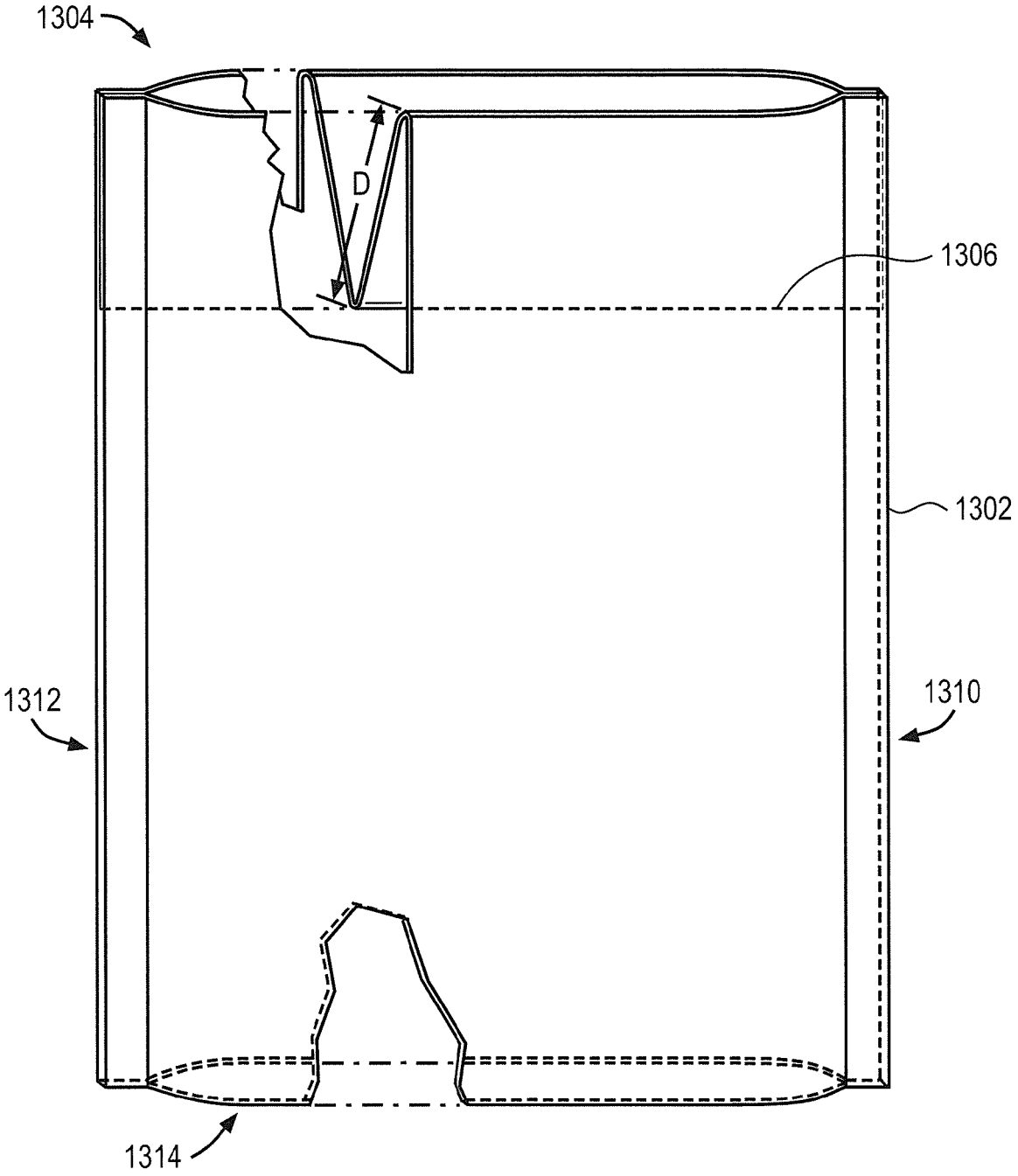
FIG. 13 illustrates a perspective view of one embodiment of a fluid holder for a fluid dispensing system.

FIG. 13 illustrates a perspective view of one embodiment of a fluid holder for a fluid dispensing system. In this embodiment, the fluid holder may be a bladder positioned within the fluid dispensing cartridge. Bladder 1302 may be dimensioned to hold fluid therein. In some embodiments, edges 1310 and 1312 of bladder 1302 are sealed together (e.g. heat sealed). Edge 1314 may be sealed around a connector (e.g. connector 108) used to connect a metering chamber (e.g. metering chamber 110) to bladder 1302. Pleat 1306 is formed in end 1304. In this aspect, bladder 1302 may be expandable from a deflated to an inflated shape. In the deflated configuration, bladder 1302 may be substantially flat. The addition of a fluid to bladder 1302 causes bladder 1302 to expand at pleat 1306 to an inflated or expanded configuration. Bladder 1302 may expand to any of the previously described shapes, e.g. to a shape having a quadrilateral cross section.

Pleat 1306 may have a depth D. Depth D of pleat 1306 may be determined based upon the desired fluid volume of bladder 1302. Representatively, as depth D of pleat 1306 increases, the fluid volume of bladder 1302 further increases. Representatively, in one embodiment where bladder 1302 has a length of about 5 inches and a width of about 4 inches in the unexpanded configuration, pleat 1306 may have a depth D of about 1 inch giving bladder 1302 a fluid volume of from about 250 mL to about 350 mL in an expanded configuration. In other embodiments, the depth D of pleat 1306 may vary from 0.60 inches to about 1.5 inches.

In still further embodiments, pleats may be included along edges 1310, 1312 of bladder 1302 and end 1304 may not include a pleat.

Figure 14A:
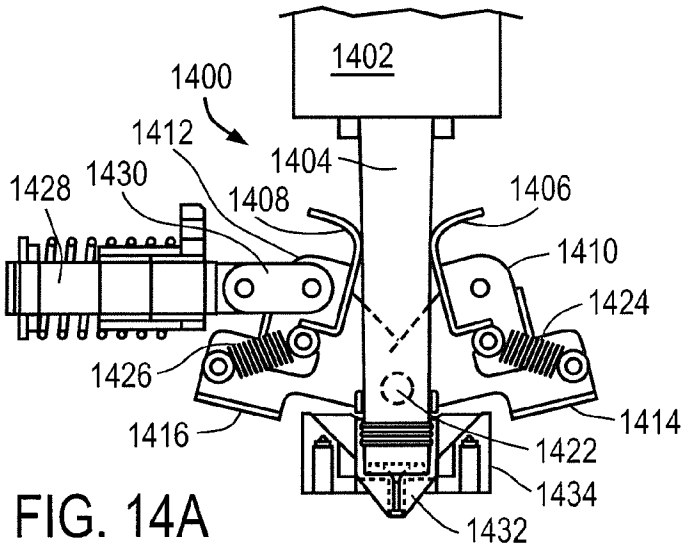
FIG. 14A illustrates a side view of one embodiment of a compression assembly for a fluid dispensing system during operation.

FIGS. 14A-14D illustrate one embodiment of a side view of a compression assembly. FIG. 14A illustrates compression assembly 1400 in an open configuration such that it is not compressing metering chamber 1404. Compression assembly 1400 may be substantially the same as compression assembly 126 described in reference to FIG. 1B. In this aspect, compression assembly 1400 may include compression members 1406, 1408 positioned along the sides of metering chamber 1404. Metering chamber 1404 extends from fluid reservoir 1402 and allows for ejection of fluid. Metering chamber 1404 and reservoir 1402 may be substantially the same as metering chamber 110 and fluid reservoir 102, respectively, described in reference to FIG. 1B. Nozzle 1432 similar to nozzle 120 described in reference to FIG. 1B is attached to an end of metering chamber 1404. An alignment member 1434 may further be attached to a bottom of compression assembly 1400 to help align metering chamber 1404 within compression assembly 1400 together with fluid dispensing cartridge 100 described in reference to FIG. 1A. Fluid dispensing cartridge 100 may be positioned on mounting assembly 1904 by ball detent seat 1908, as described in more detail in reference to FIG. 19. Although compression assembly 1400 is described in connection with a single metering chamber such as metering chamber 110 of FIG. 1B, it is contemplated that compression assembly 1400 may be used to compress more than one metering chamber, for example metering chambers 810, 812 as disclosed in reference to FIG. 8.

Compression members 1406, 1408 are substantially flat members having curved ends. A length of the flat region of compression members 1406, 1408 may be modified to control a volume of fluid dispensed from metering chamber 1404. Representatively, when compression members 1406, 1408 having a flat region length of between about 0.5 inches and about 0.6 inches are compressed against metering chamber 1404, a volume of from about 380 μL to about 480 μL may be dispensed.

Compression members 1406, 1408 may be attached to support members 1410, 1412, respectively. Support members 1410, 1412 drive movement of compression members 1406, 1408. Support members 1410, 1412 are pivotally attached (e.g. by a pin, screw or the like) to compression guides 1414, 1416, respectively. Compression guides 1414, 1416 help to support and position compression members 1406, 1408 around metering chamber 1404. Compression guides 1414, 1416 are rotatably connected to each other by pivot mechanism 1422. In this aspect, movement of compression guides 1414, 1416, and in turn support members 1410, 1412 in a direction toward one another drives movement of compression members 1406, 1408 toward metering chamber 1404. Spring 1424 is connected between support member 1410 and compression guide 1414. In this aspect, when compression guide 1414 is in the open position as illustrated in FIG. 14A, compression member 1406 is biased in a direction away from metering chamber 1404 and does not compress metering chamber 1404. Similarly, spring 1426 is connected between support member 1412 and compression guide 1416 to bias compression member 1408 in a direction away from metering chamber 1404 in the open position.

Actuator 1428 is attached to support member 1412 by link plate 1430. Link plate 1430 is pivotally attached at opposite ends to actuator 1428 and support member 1412.

Figure 14B:
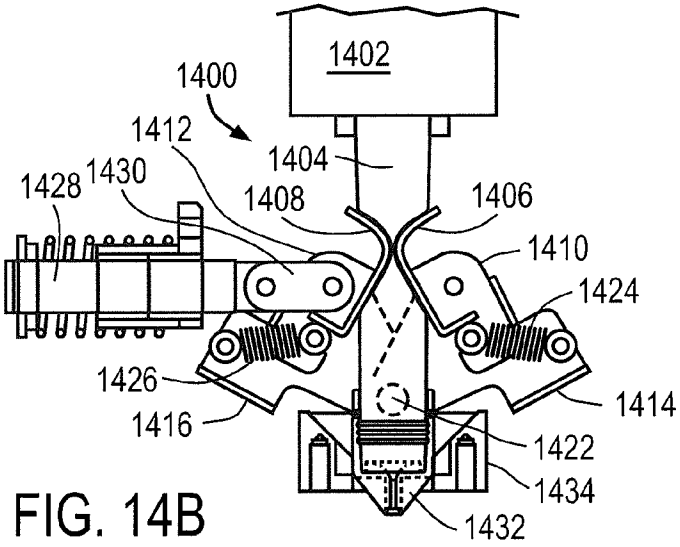
FIG. 14B illustrates a side view of one embodiment of a compression assembly for a fluid dispensing system during operation.

To compress metering chamber 1404, actuator 1428 pushes link plate 1430 in a direction toward metering chamber 1404. This movement of link plate 1430 causes support member 1412 attached to compression member 1408 to move in a direction toward metering chamber 1404. Support member 1410 and compression member 1406 also move in a direction toward metering chamber 1404. This initial movement causes the curved ends of compression members 1406, 1408 to contact metering chamber 1404. Further movement by actuator 1428 in a direction of metering chamber 1404 causes the curved ends of compression members 1406, 1408 to compress metering chamber 1404 at the same position as illustrated in FIG. 14B.

Figure 14C:
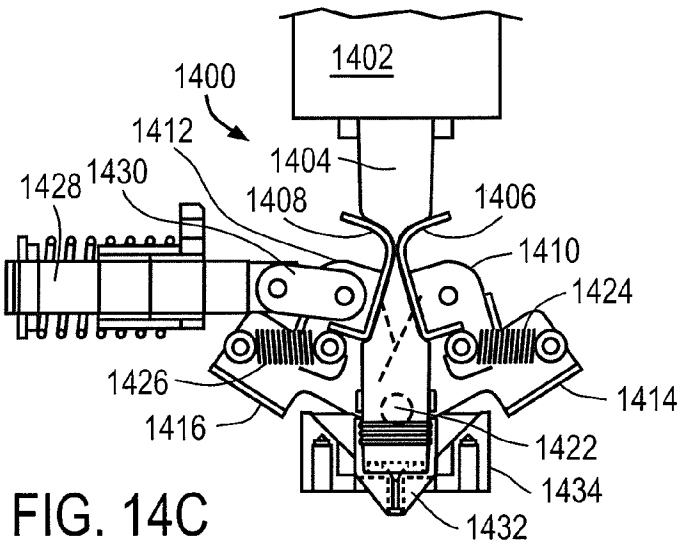
FIG. 14C illustrates a side view of one embodiment of a compression assembly for a fluid dispensing system during operation.
Figure 14D:
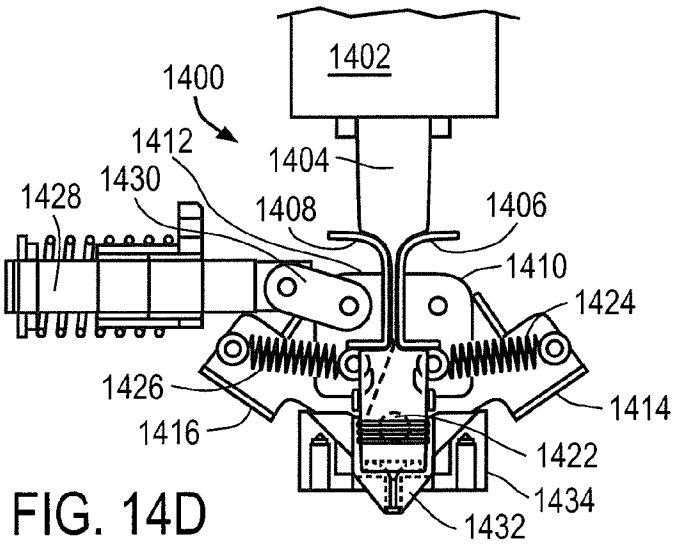
FIG. 14D illustrates a side view of one embodiment of a compression assembly for a fluid dispensing system during operation.

As illustrated in FIGS. 14C and 14D, continued movement of actuator 1428 in a direction of metering chamber 1404 causes compression members 1406, 1408 to move toward one another along the length dimension to compress a larger portion of metering chamber 1404. In particular, as actuator 1428 continues to push link plate 1430, link plate 1430 begins to move in a downward direction. Compression guides 1414, 1416 also move downward since pivot mechanism 1422 moves downward to allow compression guides 1414, 1416 to move toward one another. As further illustrated in FIG. 14C and FIG. 14D, springs 1424 and 1426 expand to allow the flat portions of compression members 1406, 1408 to rotate and compress metering chamber 1404.

When the flat portions of compression members 1406, 1408 are parallel as illustrated in FIG. 14D, compression assembly 1400 is in the closed configuration. At this position, metering chamber 1404 is fully compressed and the desired amount of fluid is ejected. Compression assembly 1400 may then be returned to the open configuration to begin another fluid ejection cycle by releasing actuator 1428 and allowing compression members 1406, 1408 to spread apart as illustrated in FIG. 14A.

During compression of metering chamber 1404, the upper most compressed portion of metering chamber 1404 (see FIG. 14B) remains compressed throughout the whole process. In this aspect, a fluid within metering chamber 1404 is prevented from leaking into a portion of metering chamber 1404 above the compressed regions. Since there is minimal risk that during the ejection process fluid will leak up metering chamber 1404 and back into housing 1402, a valve is not needed at an upper end of metering chamber 1404.

Figure 15C:
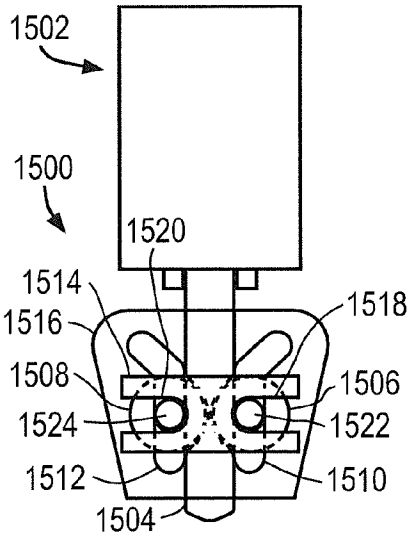
FIG. 15C illustrates a side view of another embodiment of a compression assembly for a fluid dispensing system during operation.
Figure 15B:
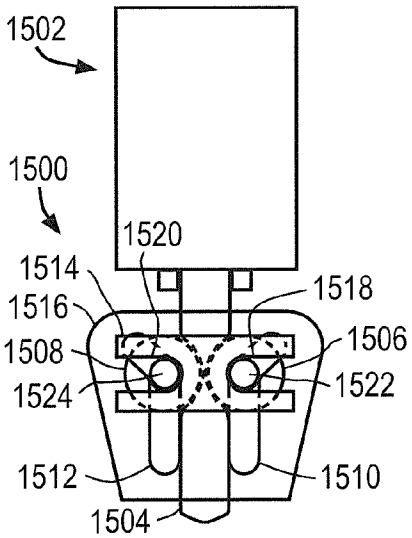
FIG. 15B illustrates a side view of another embodiment of a compression assembly for a fluid dispensing system during operation.
Figure 15A:
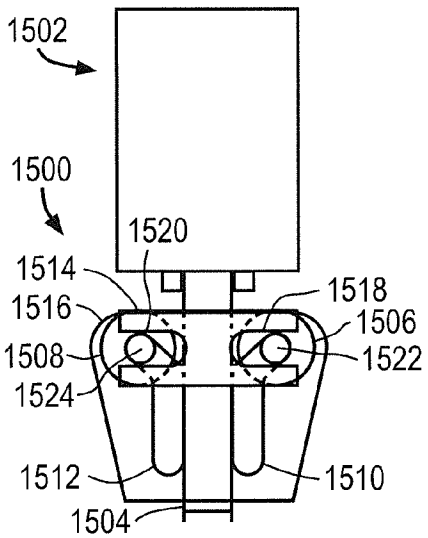
FIG. 15A illustrates a side view of another embodiment of a compression assembly for a fluid dispensing system during operation.

FIGS. 15A-15D illustrate another embodiment of a side view of a compression assembly. FIG. 15A illustrates compression assembly 1500 in an open configuration such that it is not compressing metering chamber 1504. Compression assembly 1500 may include compression members 1506, 1508 positioned along the sides of metering chamber 1504. Metering chamber 1504 extends from fluid reservoir 1502 and allows for ejection of fluid. Metering chamber 1504 and reservoir 1502 may be substantially the same as metering chamber 110 and fluid reservoir 102, respectively, described in reference to FIG. 1. Although compression assembly 1500 is described in connection with a single metering chamber such as metering chamber 110 of FIG. 1, it is contemplated that compression assembly 1500 may be used to compress more than one metering chamber, for example metering chambers 810, 812 as disclosed in reference to FIG. 8.

In this embodiment, compression members 1506, 1508 may be rollers. Rollers 1506, 1508 may roll along a length dimension of metering chamber 1504 to compress metering chamber 1504. Rollers 1506, 1508 may rotate around drive shafts 1522, 1524, respectively. Drive shafts 1522, 1524 may be positioned within tracks 1510, 1512 formed within housing 1516. Housing 1516 may enclose compression assembly 1500. Drive shafts 1522, 1524 may move along tracks 1510, 1512 to guide rollers 1506, 1508 along metering chamber 1504. Tracks 1510, 1512 may be parallel to one another along a substantial portion of the length of metering chamber 1504 and then flare out at one end. In this aspect, when drive shafts 1522, 1524 of rollers 1506, 1508 are within the flared end of tracks 1510, 1512, rollers 1522, 1524 are farther apart and do not compress metering chamber 1504 as illustrated in FIG. 15A.

Support member 1514 may be provided to drive shafts 1506, 1508 along tracks 1510, 1512. Support member 1514 may include recessed regions 1518, 1520 which receive ends of drive shafts 1522, 1524. Recessed regions 1518, 1520 are deep enough to allow drive shafts 1506, 1508 to move in a horizontal direction, e.g. toward or away from metering chamber 1504. In this aspect, when support member 1514 is moved in a vertical direction to the flared ends of tracks 1510, 1512, rollers 1506, 1508 move away from one another and are a distance apart so as not to compress metering chamber 1504 as illustrated in FIG. 15A. As support member 1514 is moved down metering chamber 1504 (i.e. in a direction away from fluid reservoir 1502) rollers 1506, 1508 move toward one another and compress metering chamber 1504 as illustrated in FIGS. 15B-15D. Once the ejection cycle has been completed (i.e., rollers 1506, 1508 are at the bottom of tracks 1510, 1512) support member 1514 is raised back up toward fluid reservoir 1502 such that rollers 1506, 1508 roll back up metering chamber 1504 to the open configuration illustrated in FIG. 15A.

Figure 15E:
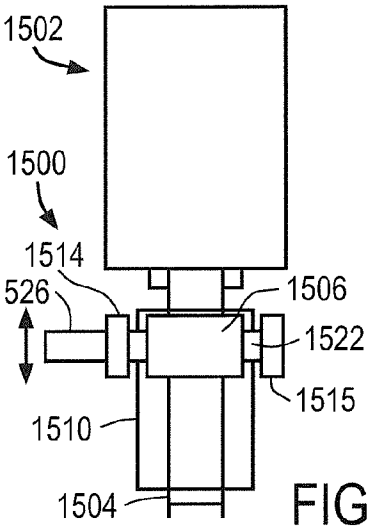
FIG. 15E illustrates a side view of another embodiment of a compression assembly for a fluid dispensing system during operation.
Figure 15D:
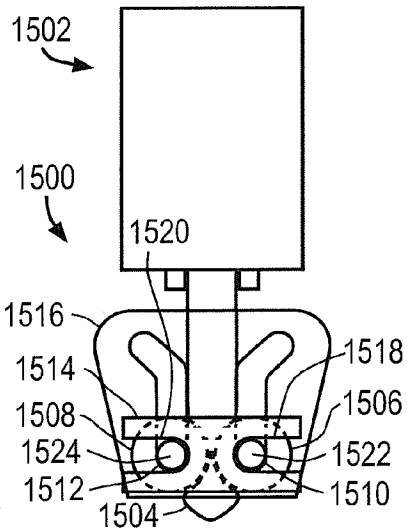
FIG. 15D illustrates a side view of another embodiment of a compression assembly for a fluid dispensing system during operation.

FIG. 15E illustrates an end view of compression assembly 1500. From this view, it can be seen that support member 1514 and support member 1515, which is identical to support member 1514, are positioned on opposite ends of drive shaft 1522. Support members 1514, 1515 guide drive shaft 1522, and in turn roller 1506, vertically along track 1510. Support members 1514, 1515 may be connected to one another by, for example, a bar or rod between support members 1514, 1515. In this aspect, support members 1514, 1515 move simultaneously.

Drive member 1526 may be connected to support member 1514 to move support members 1514, 1515 in a vertical direction. In some embodiments, drive member 1526 may be a rod attached to, and extending from, support member 1514. A robotic arm or other mechanism capable of driving movement in a vertical direction may be attached to drive member 1526 to move drive member, and in turn drive shaft 1522 and roller 1506 vertically along metering chamber 1504. Movement of drive member 1526 may be driven by a unit including a cam-crank and motor.

Figure 16C:
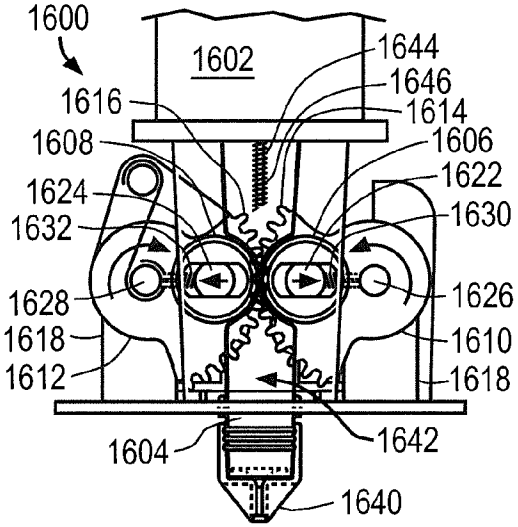
FIG. 16C illustrates a side view of another embodiment of a compression assembly for a fluid dispensing system during operation.
Figure 16B:
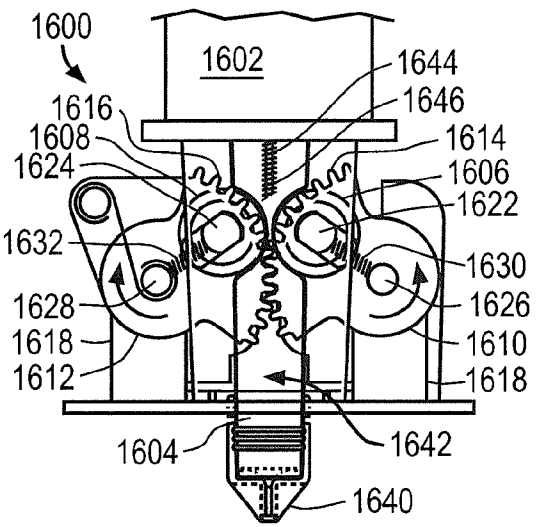
FIG. 16B illustrates a side view of another embodiment of a compression assembly for a fluid dispensing system during operation.
Figure 16A:
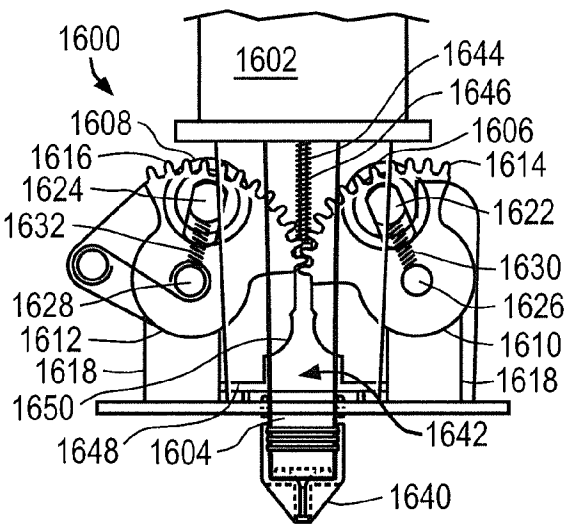
FIG. 16A illustrates a side view of another embodiment of a compression assembly for a fluid dispensing system during operation.

FIGS. 16A-16E illustrate another embodiment of a compression assembly. FIG. 16A illustrates compression assembly 1600 in an open configuration such that it is not compressing metering chamber 1604. Compression assembly 1600 may include compression members 1606, 1608 positioned along the sides of metering chamber 1604. Metering chamber 1604 extends from fluid reservoir 1602 and allows for ejection of fluid. Nozzle 1640 may be attached to an end of metering chamber 1604. Reservoir 1602, metering chamber 1604, and nozzle 1640 may be substantially the same as fluid reservoir 102, metering chamber 110 and nozzle 120, respectively, described in reference to FIG. 1B. Although compression assembly 1600 is described in connection with a single metering chamber such as metering chamber 110 of FIG. 1B, it is contemplated that compression assembly 1600 may be used to compress more than one metering chamber, for example metering chambers 810, 812 as disclosed in reference to FIG. 8.

In this embodiment, compression members 1606, 1608 may be rollers. Rollers 1606, 1608 may be positioned around drive shafts 1622, 1624, respectively, which facilitate rotation of rollers 1606, 1608. Drive shafts 1622, 1624 may be attached to pivot arms 1610, 1612. Pivot arms 1610, 1612 pivot about shafts 1626, 1628, respectively, so as to drive the attached drive shafts 1622, 1624 and in turn rollers 1606, 1608 vertically along the length of metering chamber 1604.

Spreader 1642 may be positioned between rollers 1606, 1608 once they reach a bottom portion of metering chamber 1604 to increase a distance between rollers 1606, 1608 as they travel back up metering chamber 1604. If rollers 1606, 1608 are not spread apart before traveling back up metering chamber 1604, a vacuum is created in the lower portion of metering chamber 1604 (region between rollers 1606, 1608 and the valve). This vacuum causes air to be sucked into metering chamber 1604. The air travels up metering chamber 1604 and into fluid reservoir 1602. The addition of air to the fluid within reservoir 1602 could negatively affect the fluid. For example, the addition of air to a reagent within fluid reservoir 1602 increases oxidation of the reagent.

Spreader 1642 includes base member 1648 positioned around metering chamber 1604 and side member 1650 extending vertically between rollers 1606, 1608. Side member 1650 has a substantially triangular shape with the widest portion positioned near base member 1648 such that a distance between rollers 1606, 1608 is increased as rollers 1606, 1608 reach an end of metering chamber 1604. Spreader 1642 is movably positioned along rod 1644. Representatively, side member 1650 of spreader 1642 includes a channel (not shown) dimensioned to fit around a portion of rod 1644 and allow spreader 1642 to slide along rod 1644. Rod 1644 includes spring 1646 encircling an upper region of rod 1644, above spreader 1642 to bias spreader 1642 in a direction away from housing 1602. A second side member, rod and spring (not shown) identical to side member 1650, rod 1644 and spring 1646 are found at an opposite side of spreader 1642. During operation, rollers 1606, 1608 roll along metering chamber 1604 and spreader 1642 until they reach a lower portion of metering chamber 1604. When they reach the lowest portion of metering chamber 1604, spreader 1642 spreads rollers 1606, 1608 apart. As rollers 1606, 1608 travel back up a length of metering chamber 1604, spreader 1642 may remain between rollers 1606, 1608 for a portion of the length to ensure that rollers remain a sufficient distance apart as they travel back up metering chamber 1604 to the open position. Spreader 1642 is eventually released and pushed by down toward a base of support member 1618 by spring 1646.

Gears 1614, 1616 control movement of rollers 1606, 1608. Gears 1614, 1616 may include complimentary teeth or cogs such that rotation of one drives rotation of the other. Representatively, when compression assembly 1600 is in the open configuration as illustrated in FIG. 16A, gear 1614 rotates in a counter clockwise direction driving rotation of gear 1616 in a clockwise direction. This in turn causes arm 1610 to pivot in the counter clockwise direction and arm 1612 to pivot in the clockwise direction. The pivoting of arms 1610, 1612 moves rollers 1606, 1608 toward one another to compress metering chamber 1604 and vertically along metering chamber 1604, in a direction away from fluid reservoir 1602. In this aspect, metering chamber 1604 is compressed along its length and fluid within metering chamber 1604 is pushed out an end of metering chamber. Once the ejection cycle has been completed (i.e., rollers 1606, 1608 are at the bottom of metering chamber 1604) rollers 1606, 1608 may roll back up metering chamber 1604 to the open configuration illustrated in FIG. 16A. In other embodiments, gears continue to rotate such that rollers 1606, 1608 are drawn away from metering chamber 1604 and around until they are back in the position illustrated in FIG. 16A.

Gears 1614, 1616 may be driven by a motorized device or other similar device suitable for driving gears. In still further embodiments, gears 1614, 1616 may be driven manually by the user.

Gears 1614, 1616 and any motorized device associated therewith may be supported by support member 1618. Support member 1618 may be any structure suitable for supporting and coupling gears 1614, 1616 to the fluid dispensing cartridge.

In some embodiments, rollers 1606, 1608 may include spring assemblies 1630, 1632, respectively. Spring assemblies 1630, 1632 allow rollers 1606, 1608 to be refracted as necessary. For example, in order for rollers 1606, 1608 to compress metering chamber 1604 along its length as illustrated in FIGS. 16B-16D, rollers 1606, 1608 must extend beyond arms 1610, 1612 as illustrated in FIGS. 16B and 16D. When rollers 1606, 1608 meet at diametrically opposed sides of metering chamber 1604 as illustrated in FIG. 16C, however, they do not need to extend as far to compress metering chamber 1604. In this aspect, spring assemblies 1630, 1632 allow for retraction of rollers 1606, 1608 when necessary.

Figure 16E:
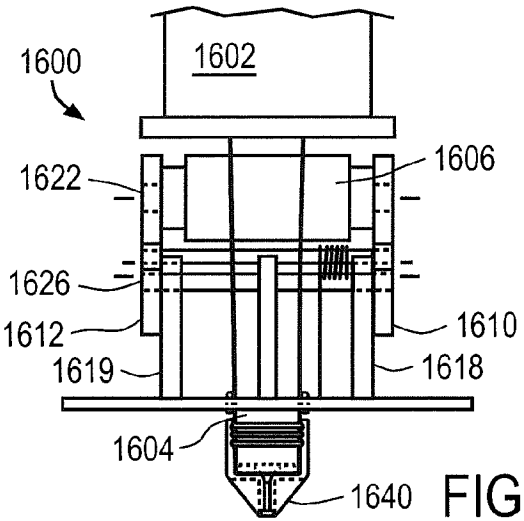
FIG. 16E illustrates a side view of another embodiment of a compression assembly for a fluid dispensing system during operation.
Figure 16D:
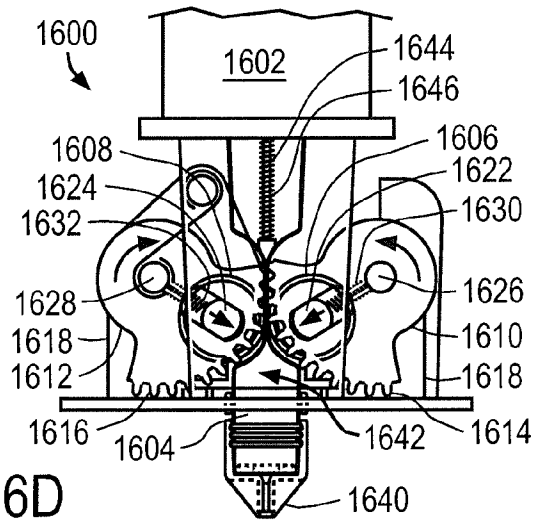
FIG. 16D illustrates a side view of another embodiment of a compression assembly for a fluid dispensing system during operation.

FIG. 16E illustrates an end view of compression assembly 1600. From this view, it can be seen that opposite ends of drive shaft 1622 are supported by pivot arms 1610, 1612. Pivot arms 1610, 1612 are attached to shaft 1626 which is in turn attached to gear 1614. As gear 1614 rotates in either a clockwise or counterclockwise direction, gear 1614 rotates shaft 1626, causing pivot arm 1610 to pivot and in turn roller 1606 to roll along a length of metering chamber 1604. Roller 1608 may be controlled in a similar manner such that rollers 1606, 1608 roll along the length of metering chamber 1604 in the same direction and at the same speed.

Figure 17:
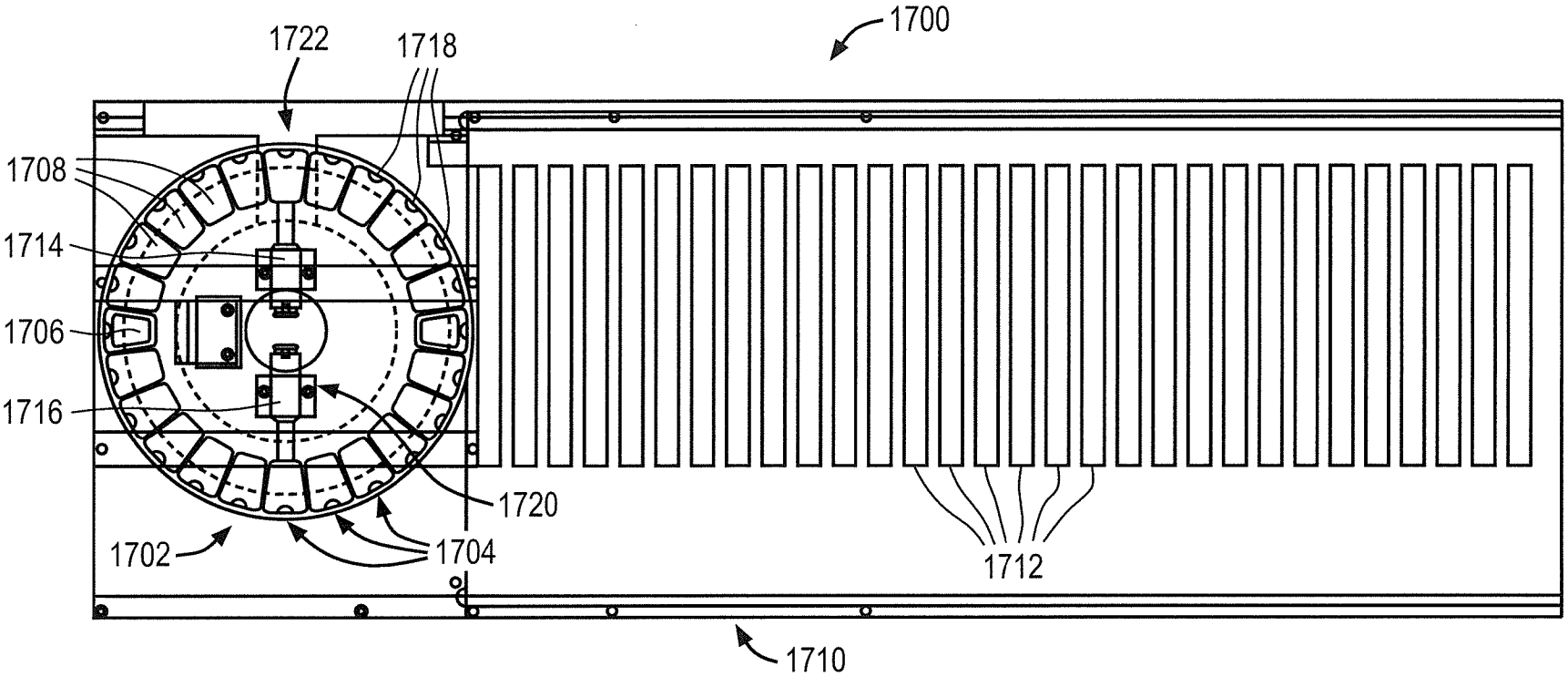
FIG. 17 illustrates a top view of one embodiment of a fluid dispensing system.
Figure 18:
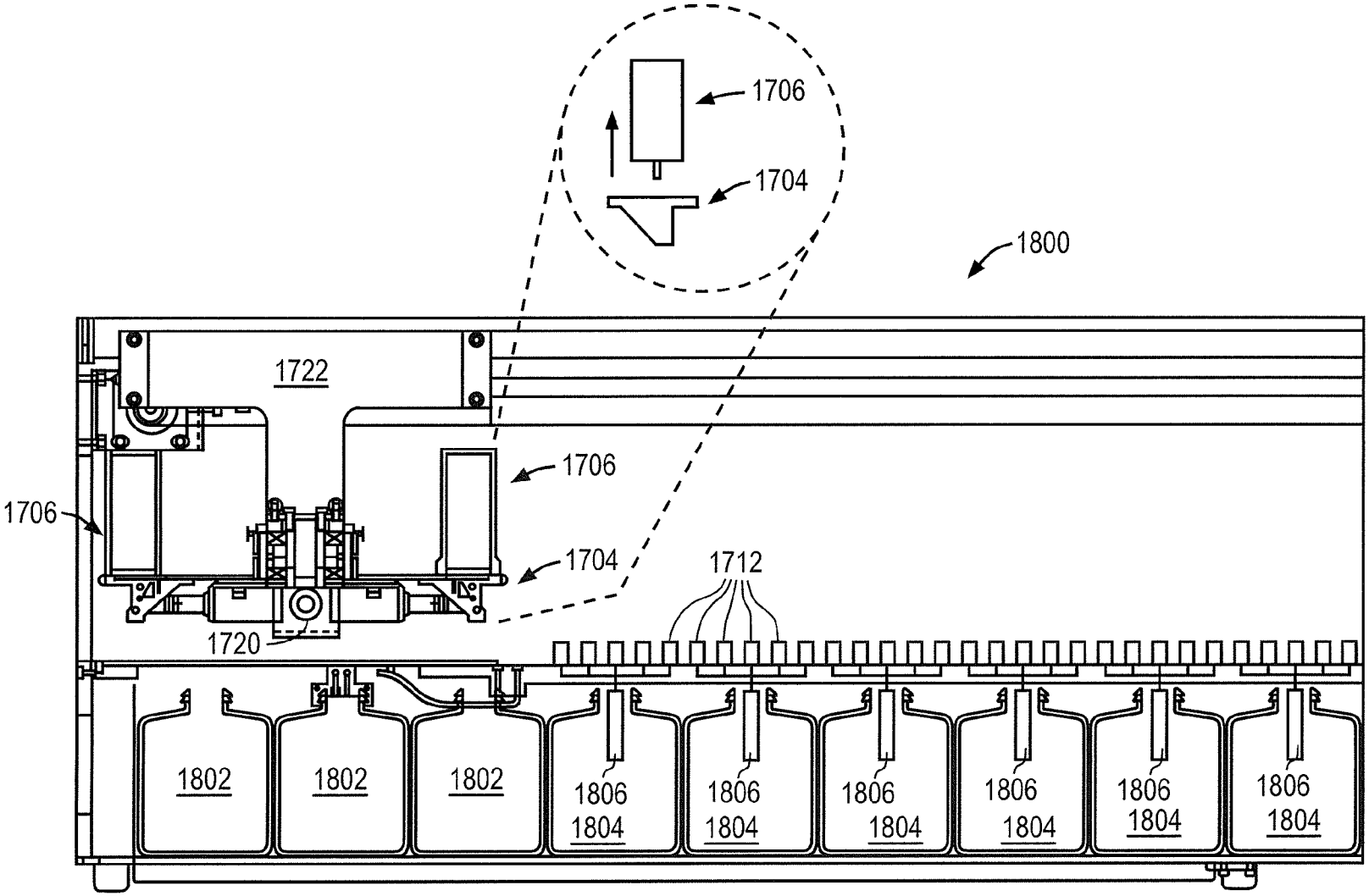
FIG. 18 illustrates a side cross-sectional view of the fluid dispensing system of FIG. 17.

FIGS. 17 and 18 illustrate one embodiment of a fluid dispensing system. The geometry and mechanism of fluid dispensing system 1700 is variable depending on the operation of the fluid dispensing cartridge selected for use with system 1700. As best seen in FIG. 17, system 1700 optionally includes mounting assembly 1702 having a plurality of stations 1704 at which fluid dispensing cartridge 1706 may be mounted. Fluid dispensing cartridge 1706 may be substantially the same as fluid dispensing cartridge 100 described in reference to, for example, FIG. 1A-1B and FIGS. 8-10. Stations 1704 preferably include mounting apertures 1708 for selectively positioning a plurality of fluid dispensing cartridges 1706 adjacent to actuator assembly 1720. A compression assembly such as one of those previously described may be mounted to each of stations 1704 (see FIG. 19). Actuator assembly 1720 may be aligned with a selected compression assembly to activate the compression assembly when desired. The compression assemblies are mounted to stations 1704 such that when cartridges 1706 are positioned within apertures 1708, the metering chamber is aligned with the respective compression assembly.

Fluid dispensing system 1700 also optionally includes receiving assembly 1710 retaining a plurality of receiving members 1712. Receiving members 1712 may be any item on which it is desired to dispense fluids from cartridges 1706. Examples of suitable receiving members 1712 are slides, trays and mixing baths. In a preferred embodiment, receiving members 1712 are microscope slides supported on support members. The microscope slides may have substrates mounted thereon. Examples of suitable substrates are thin slices of tissue samples.

Generally speaking, receiving assembly 1710 is positioned beneath mounting assembly 1702 taking advantage of gravity to deliver fluids dispensed from cartridges 1706. Preferably, mounting assembly 1702 and receiving assembly 1710 are movable with respect to one another so that the plurality of cartridges 1706 can be positioned to dispense fluids on any desired receiving member 1712. Any combination of movability of the mounting assembly 1702 and the receiving assembly 1712 may be selected. For example, both may be movable or only one may be movable and the other stationary. Still further, mounting assembly 1702 may be a carousel that is rotatable about a central axis so as to align the cartridges 1706 with the desired receiving member 1712. Mounting assembly 1702 may also be linearly translatable such that it may move from one receiving member 1712 to the next. As shown in FIG. 18, receiving members 1712 may all be the same type of items, such as slides or alternatively may include different types of items such as slides and containers.

In one example of operation of the dispensing system 1700, mounting assembly 1702 is rotated so that individual cartridges 1706 are selectively positioned adjacent one or both of actuator assembly 1720. Alternatively, system 1700 may include a plurality of actuator assemblies 1720 which are positioned adjacent to each cartridge 1706 such that rotation of mounting assembly 1702 to align each cartridge 1706 with actuator assembly 1720 is not required.

Actuator assembly 1720 can be any activation device that triggers cartridge 1706 to emit a controlled amount of fluid. Representatively, actuator assembly 1720 may include a piston mechanism that aligns with, for example, actuator 1428 of compression assembly 1400 (see FIGS. 14A-14D). Actuator assembly 1720 includes, for example, a solenoid, that in response to an electrical signal moves a piston. The piston may be extended to move actuator 1428 in a direction of metering chamber 1404. As previously described in reference to FIGS. 14A-14D, such movement causes compression assembly 1400 to squeeze metering chamber 1404 and ejection of a fluid from metering chamber 1404. Actuator assembly 1720 may be controlled by a processor or controller (as shown) that operates the fluid dispensing system.

Mounting assembly 1702 may be both translated and rotated with respect to receiving assembly 1710 so that an individual cartridge 1706 can be selectively positioned above any receiving member 1712. Once cartridge 1706 is positioned above one of receiving members 1712, actuator assembly 1720 triggers cartridge 1706 to emit a controlled amount of fluid onto receiving member 1712.

As seen in FIGS. 17 and 18, in one embodiment mounting assembly 1702 is rotatably attached to support member 1722 such that cartridges 1706 can be rotated with respect to actuator assembly 1720. Actuator assembly 1720 is fixedly attached to support member 1722, optionally beneath mounting assembly 1702. Preferably, support member 1722 can be translated horizontally such that the cartridges 1706 can be both rotated and translated with respect to the receiving members 1712. In this manner, a chosen cartridge 1706 can be selectively positioned above any receiving member 1712.

Although receiving members 1712 are shown linearly positioned within receiving assembly 1710, it is further contemplated that receiving members 1712 may be divided into two or more rows. In this aspect, actuator assembly 1720 may optionally include two or more actuators, for example, two actuators 1714, 1716 used to dispense fluid onto two rows of receiving members. In operation, actuator 1714 is adapted to dispense fluids onto receiving members 1712 in one row and actuator 1716 is adapted to dispense fluids onto receiving members 1712 in another row. It is further contemplated that any number of actuators and/or receiving members can be employed without departing from the scope of the present invention.

As shown in FIG. 18, system 1800 optionally includes supply containers 1802, drain containers 1804 and valves 1806. Supply containers 1802 can be used to hold liquids such as water for rinsing receiving members 1712. Valves 1806 preferably include switches for directing the flow of liquids when rinsing receiving members 1712. In addition, valves 1806 are used to direct the flow of liquids into drain containers 1804 after the liquids have been used to rinse receiving members 1712.

As illustrated in the exploded view of cartridge 1706 and station 1704, cartridge 1706 (including the metering chamber(s)) is removably positioned within station 1704. Station 1704 including a compression assembly mounted thereto is fixedly mounted to support member 1722. In this aspect, once cartridge 1706 is empty, cartridge 1706 and its associated metering chamber(s) is removed from station 1704 while the compression assembly remains mounted to the dispensing system at station 1704. A replacement cartridge and metering chamber(s) may then be placed in station 1704. In other embodiments, the compression assembly may be mounted to cartridge 1706. In this aspect, each of cartridges 1706 includes a compression assembly and removal of cartridge 1706 also removes the compression assembly.

Figure 19:
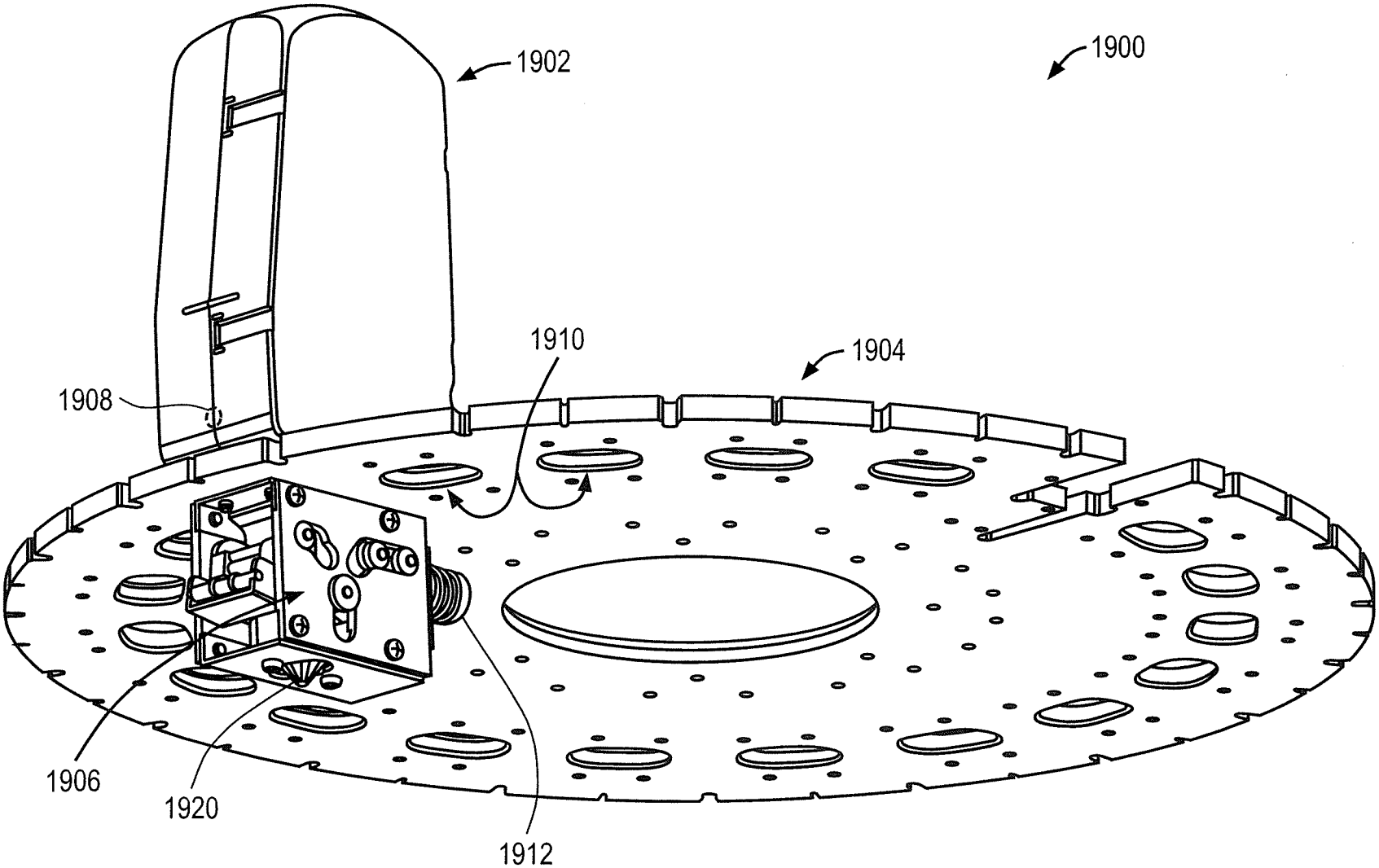
FIG. 19 illustrates a perspective view of one embodiment of a fluid dispensing system.

Turning now to the structure of cartridges 1706, in some embodiments, a horizontal cross-sectional shape of the cartridges 1706 lacks symmetry. In this way, mounting aperture 1708 in mounting assembly 1702 is similarly shaped requiring insertion to be in a particular desired orientation. For example, a substantially trapezoidal shape may be selected promoting the desired placement orientations. FIG. 19 shows an example of cartridges 1706 having a substantially trapezoidal cross-section. In this aspect, cartridges 1706 are adapted to fit within substantially trapezoidal mounting apertures 1708 (as shown in FIG. 17). In other embodiments, the mounting apertures 1708 and cartridges 1706 are other similarly oriented shapes that lack symmetry. Alternatively, cartridges 1706 and mounting apertures 1708 may have any shape or dimension suitable for positioning cartridges 1706 within stations 1704 and dispensing a fluid onto the underlying samples.

Optionally a mounting mechanism can be utilized to releasably attach cartridge 1706 within a corresponding mounting aperture 1708 of mounting assembly 1702. In one example, as shown in FIG. 19, a ball detent seat 1908 is provided on an exterior surface of the housing of cartridge 1902. As seen in FIG. 17, corresponding balls 1718, optionally spring loaded, may be situated on mounting assembly 1702 adjacent each mounting aperture 1708. Before insertion into mounting aperture 1708, cartridge 1902 must be properly aligned such that the trapezoidal shape of cartridge 1902 is in vertical alignment with the corresponding trapezoidal mounting aperture 1708. For proper insertion, cartridge 1902 must be pushed downward with sufficient force so that ball 1718 slides into position within seat 1908.

FIG. 19 illustrates a perspective view of one embodiment of a fluid dispensing system. Fluid dispensing system 1900 generally includes fluid dispensing cartridge 1902 and compression assembly 1906 mounted to mounting assembly 1904. Fluid dispensing cartridge 1902 may be substantially the same as cartridge 100 described in reference to FIG. 1B. Compression assembly 1906 may be substantially the same as compression assembly 1400 described in reference to FIGS. 14A-14D. It is further contemplated that compression assembly 1906 may be the same as any of the other compression assemblies described herein. Mounting assembly 1904 may be substantially the same as mounting assembly 1702 described in reference to FIG. 17. Although fluid dispensing cartridge 1902 and compression assembly 1906 are shown mounted to mounting assembly 1904, it is contemplated that other components used for processing of samples within an underlying receiving member may further be mounted to mounting assembly 1904.

As previously discussed in reference to FIGS. 17-18, fluid dispensing cartridge 1902 is positioned within a station along an upper surface of mounting assembly 1702. Openings 1910 are formed through mounting assembly 1702 beneath each station. A metering chamber (not shown) of fluid dispensing cartridge 1902 is inserted through a corresponding opening 1910. Compression assembly 1906 is mounted below the mounting station, on a side of mounting assembly 1702 opposite the mounting station. The metering chamber extending through opening 1910 of mounting assembly 1702 is positioned within compression assembly 1906. Nozzle 1920 of the metering chamber extends out a bottom of compression assembly 1906. Actuator 1912 of compression assembly 1906 is facing a center of mounting assembly 1904 such that an oppositely facing actuator assembly (see actuator assembly 1720 of FIGS. 17-18) is aligned with actuator 1912.

Figure 20:
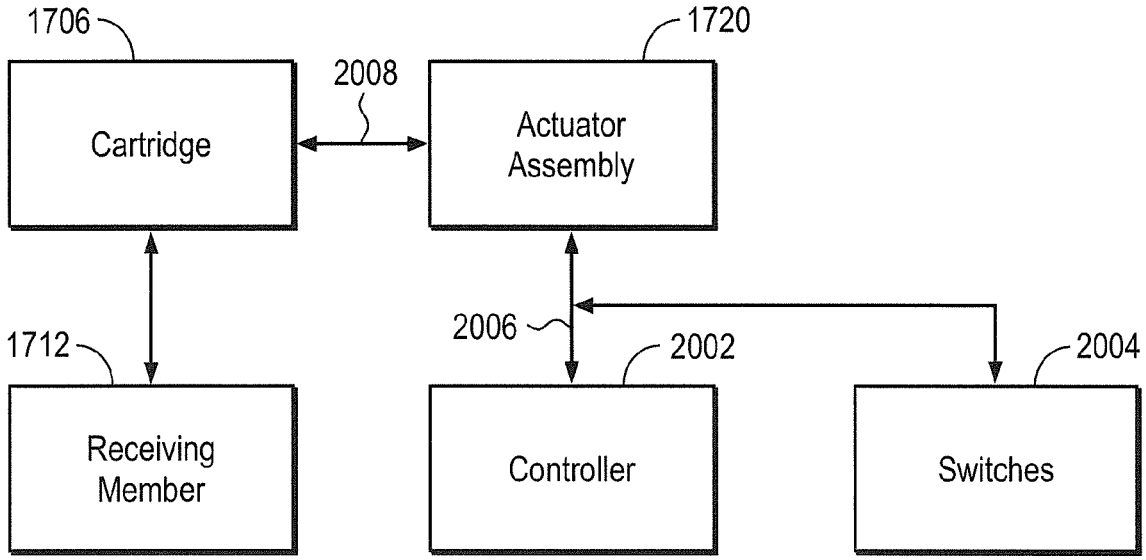
FIG. 20 is a flowchart of one embodiment of a fluid dispensing system.

With reference to FIG. 20, actuator assembly 1720 is preferably activated using controller 2002 including switches 2004. Optionally controller 2002 is a programmable computer having a wireless communication link 2006 with actuator assembly 1720. Controller 2002 includes, for example, machine readable media that when executed, causes the operation of actuator assembly 1720. Alternatively, controller 2002 is anything that causes actuator assembly 1720 to be activated and may include a wire communication link and/or a wireless communication link. Once activated, actuator assembly 1720 may utilize magnetic link 2008 to cause fluid dispenser 1706 to dispense fluid onto a receiving member 1712.

It should also be appreciated that reference throughout this specification to "one embodiment", "an embodiment", or "one or more embodiments", for example, means that a particular feature may be included in the practice of the invention. Similarly, it should be appreciated that in the description various features are sometimes grouped together in a single embodiment, Figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a fluid reservoir;

a compressible metering chamber comprising a first end coupled to the fluid reservoir and a second end;

a valve coupled to the second end of the metering chamber, the valve having a deformable base member and a deformable skirt member positioned around the deformable base member; and a nozzle coupled to the valve, the nozzle having a reservoir within which the valve is positioned, wherein the reservoir defines an annular chamber having an inner side and an outer side which are substantially parallel and face one another, wherein a distance between the inner side and the outer side define a gap, wherein a portion of the deformable skirt member lies in the gap, wherein a thickness of the gap is greater than a thickness of the portion of the deformable skirt member such that the deformable skirt member forms a seal with the outer side of the annular chamber when the deformable base member is in the open position and a seal with the inner side of the annular chamber when the deformable base member is in a closed position.

2. The apparatus of claim 1 wherein the fluid reservoir comprises a housing defining a chamber and an expandable bladder positioned within the chamber.

3. The apparatus of claim 2 wherein the expandable bladder comprises a quadrilateral cross section in the expanded configuration.

4. The apparatus of claim 2 wherein the expandable bladder comprises at least one pleat.

5. The apparatus of claim 1 wherein the first end is an unopposed fluid conduit formed by a connector inserted within the first end of the metering chamber and a fluid passes through the fluid conduit directly to the metering chamber.

6. The apparatus of claim 1 wherein the valve is the only valve coupled to the metering chamber.

7. The apparatus of claim 1 wherein the valve is a liquid retention valve.

8. The apparatus of claim 1 wherein the valve comprises flaps that open in response to compression of the metering chamber.

9. The apparatus of claim 1 wherein the valve comprises an opening having a single slit, Y or cross shaped dimension.

10. The apparatus of claim 1 wherein the metering chamber is a first metering chamber and a second metering chamber is coupled to the fluid reservoir.

11. The apparatus of claim 10 wherein the valve is a first valve coupled to the first metering chamber and a second valve is coupled to the second metering chamber.

12. The apparatus of claim 10 wherein the nozzle is a first nozzle coupled to the first metering chamber and a second nozzle is coupled to the second metering chamber.

13. The apparatus of claim 12 wherein the first nozzle comprises a first channel and the second nozzle comprises a second channel, the first channel directs a fluid flowing from the first nozzle toward a fluid flowing from the second nozzle.

14. The apparatus of claim 1 wherein the nozzle comprises a fluid conduit having a counter bore formed within an end of the fluid conduit.

15. The apparatus of claim 14 wherein the fluid conduit comprises a length greater than its width and the counter bore comprises a length less than the length of the fluid conduit and width greater than a width of the fluid conduit.

16. The apparatus of claim 1 wherein the compressible metering chamber is tapered.

17. The apparatus of claim 1 further comprising:

a nozzle locking mechanism removably positioned around the metering chamber, wherein the nozzle locking mechanism secures the nozzle to the second end of the metering chamber.

18. An apparatus comprising:

a fluid reservoir;

a compressible metering chamber comprising a first end coupled to the fluid reservoir and a second end;

a deformable valve coupled to the second end of the metering chamber; and a nozzle coupled to the deformable valve, wherein the nozzle defines a reservoir connected to a fluid outlet channel, wherein the reservoir comprises an annular chamber having an inner side and an outer side which are substantially parallel and face one another, wherein a distance between the inner side and the outer side define a gap, wherein a portion of the deformable valve lies in the gap, wherein a thickness of the gap is greater than a thickness of the portion of the deformable valve such that the portion of the deformable valve within the gap forms a seal with the outer side of the annular chamber when the deformable valve is in an open position and a seal with the inner side of the annular chamber when the deformable valve is in a closed position.

* * * * *